US007931474B2

(12) United States Patent
Laurx et al.

(10) Patent No.: US 7,931,474 B2
(45) Date of Patent: Apr. 26, 2011

(54) HIGH-DENSITY, ROBUST CONNECTOR

(75) Inventors: John C. Laurx, Aurora, IL (US); Peerouz Amleshi, Lisle, IL (US); David E. Dunham, Aurora, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/549,101

(22) Filed: Aug. 27, 2009

(65) Prior Publication Data

US 2010/0055933 A1 Mar. 4, 2010

Related U.S. Application Data

(60) Provisional application No. 61/092,589, filed on Aug. 28, 2008.

(51) Int. Cl.
*H01R 12/00* (2006.01)

(52) U.S. Cl. ..... 439/65; 439/607.07

(58) Field of Classification Search ..... 439/79, 439/607.05–607.09, 701
See application file for complete search history.

(56) References Cited

U.S. PATENT DOCUMENTS

| | | | | |
|---|---|---|---|---|
| 6,083,047 | A * | 7/2000 | Paagman | 439/607.07 |
| 6,979,202 | B2 * | 12/2005 | Benham et al. | 439/65 |
| 7,335,063 | B2 * | 2/2008 | Cohen et al. | 439/607.09 |
| 7,553,190 | B2 * | 6/2009 | Laurx et al. | 439/607.07 |
| 7,731,537 | B2 * | 6/2010 | Amleshi et al. | 439/607.05 |
| 2007/0021003 | A1 * | 1/2007 | Laurx et al. | 439/608 |

* cited by examiner

*Primary Examiner* — Briggitte R Hammond
*Assistant Examiner* — Larisa Z Tsukerman
(74) *Attorney, Agent, or Firm* — Stephen L. Sheldon

(57) ABSTRACT

A high speed connector includes a plurality of wafer-style components, the wafers including two columns of conductive terminals that are supported in an insulative support body by a plurality of channels. Ribs may be provided to help secure one of the terminals in one of the plurality of channels. The two columns of terminals are configured to form broadside coupled terminal pairs and an air channel is at least partially disposed in the wafer between two adjacent broadside coupled terminal pairs.

7 Claims, 33 Drawing Sheets

FIG.3
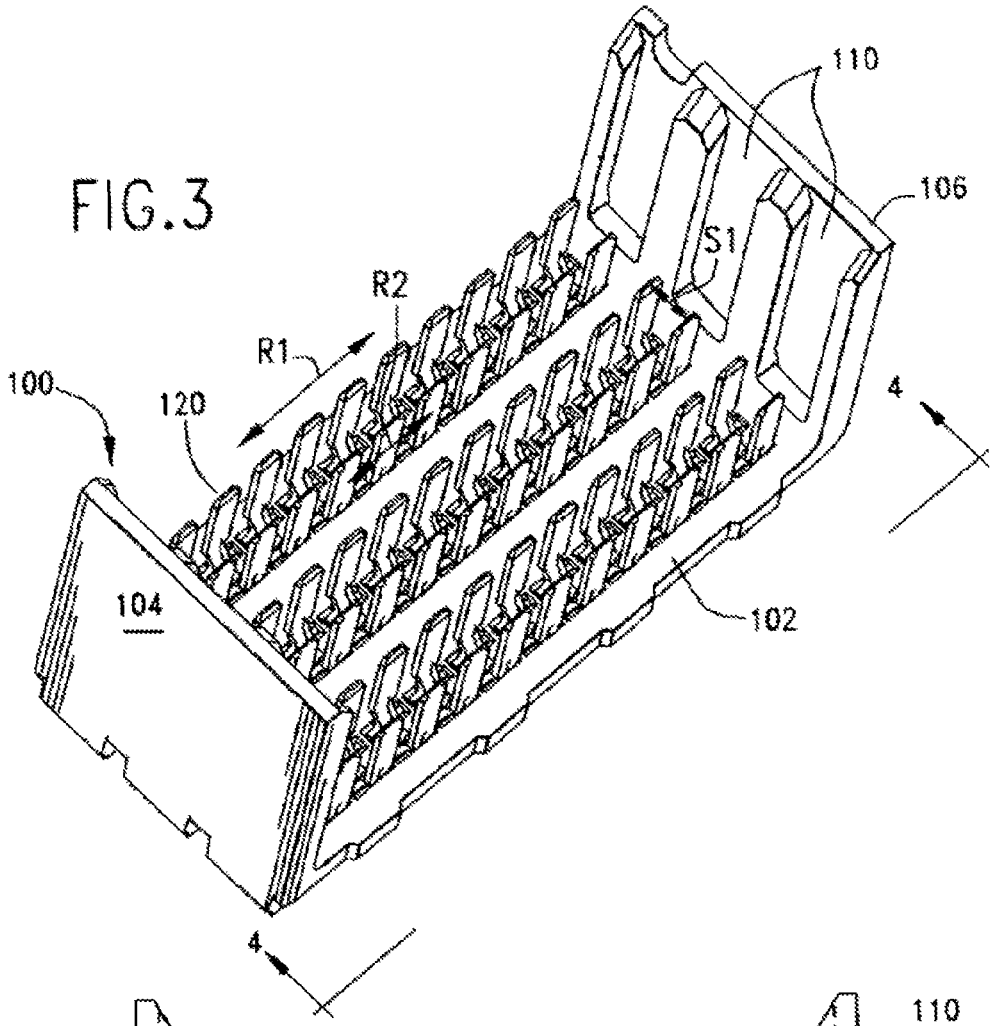
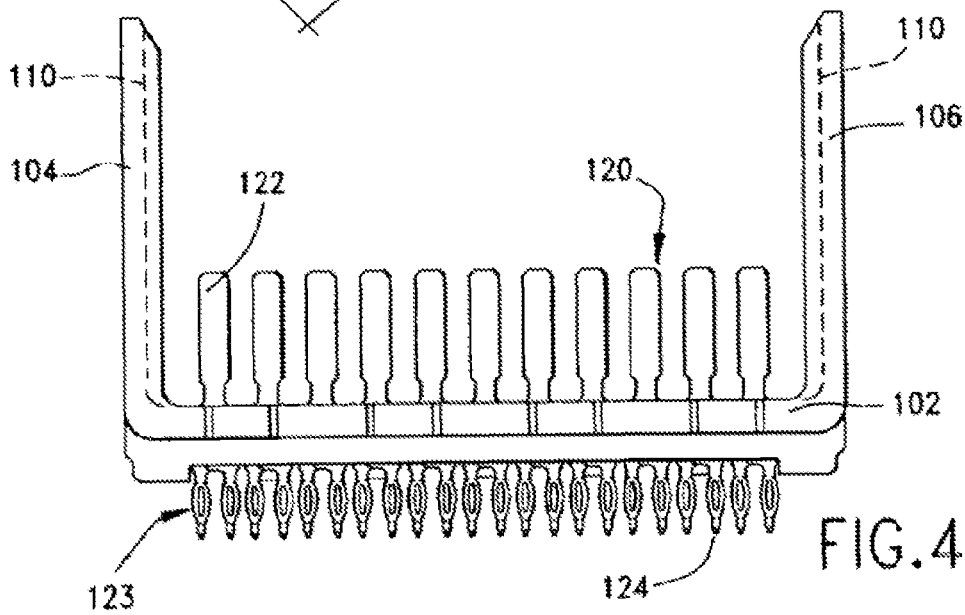
FIG.4

FIG.4A
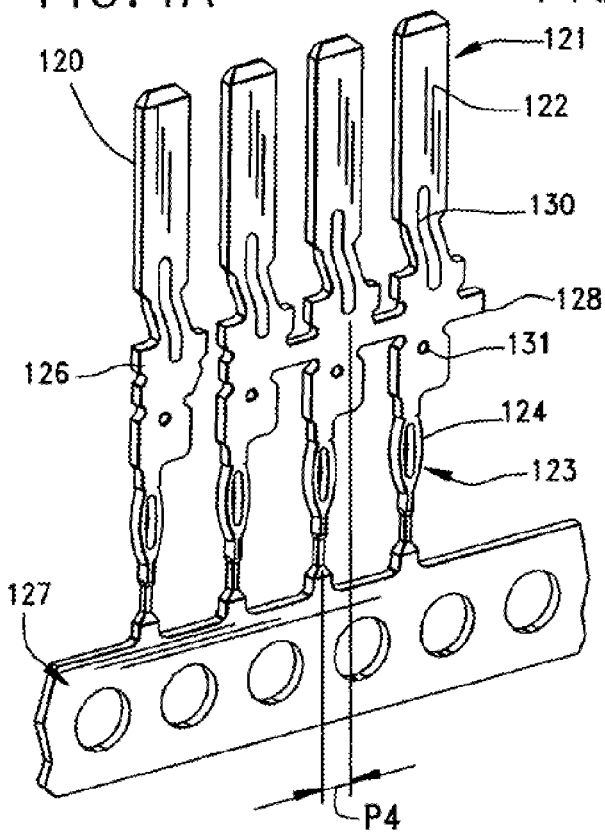
FIG.4B
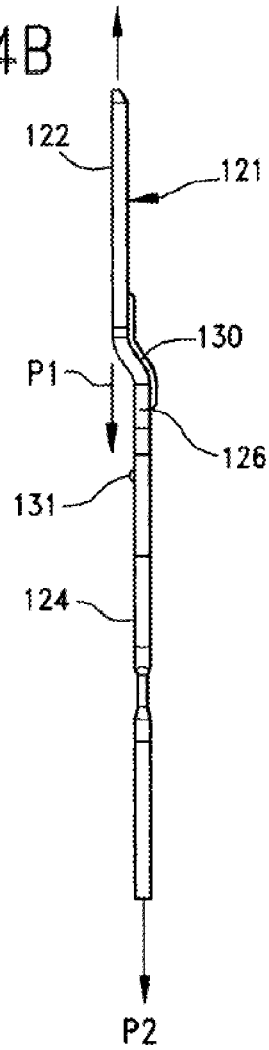
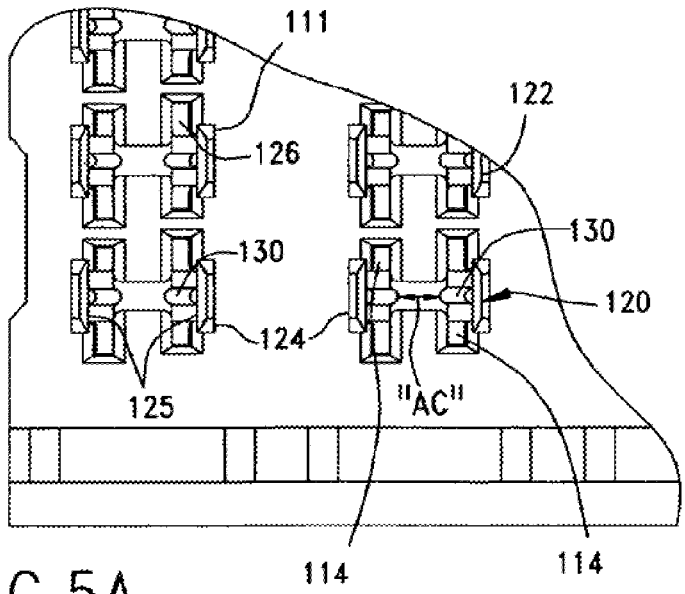
FIG.5A

FIG.5B
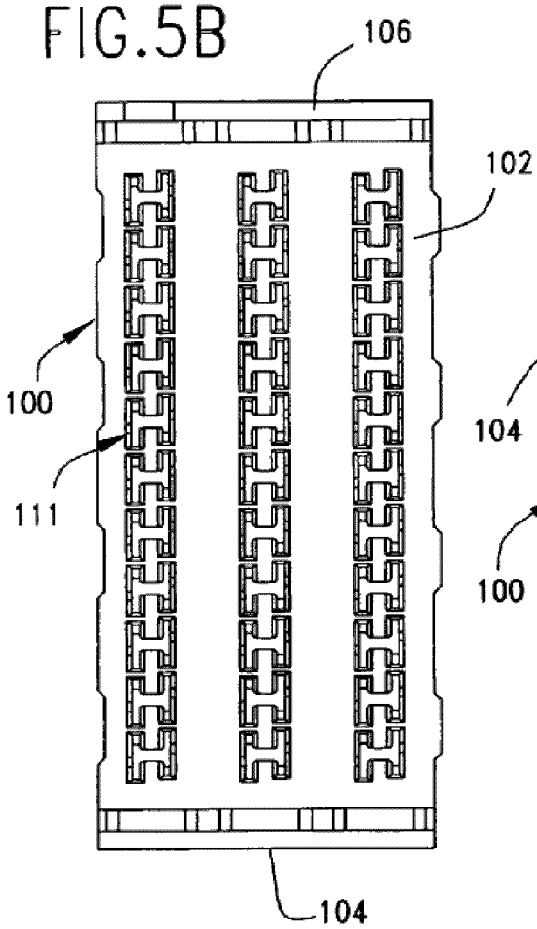
FIG.5D
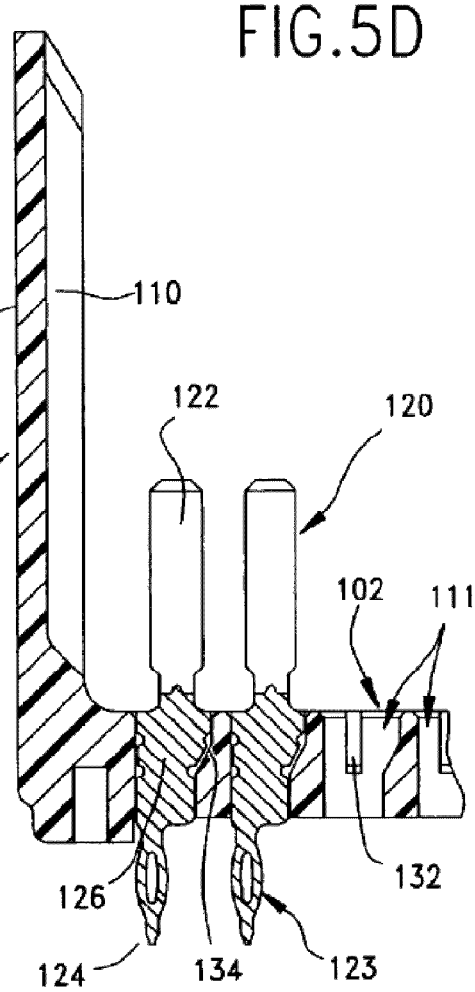
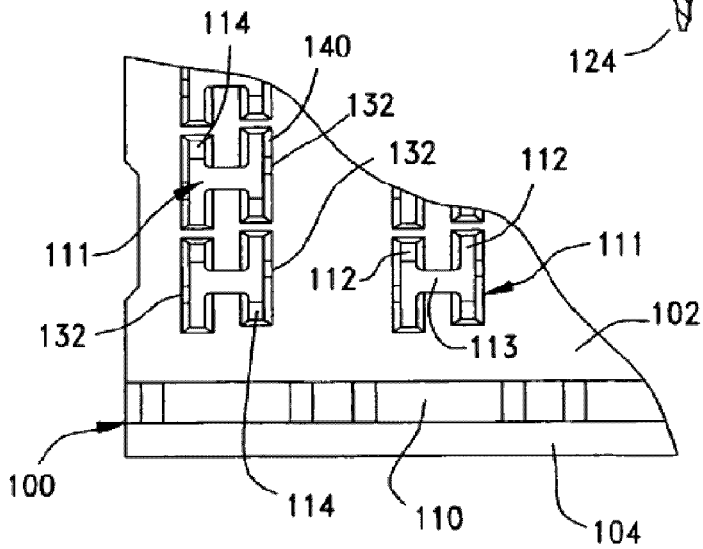
FIG.5C

HIGH-DENSITY, ROBUST CONNECTOR

REFERENCE TO RELATED APPLICATIONS

N/A

BACKGROUND OF THE INVENTION

The present invention pertains generally to electrical connectors, and more particularly to an improved connector suitable for use in backplane applications.

Backplanes are large circuit boards that contain various electrical circuits and components. They are commonly used in servers and routers in the information and technology areas. Backplanes are typically connected to other backplanes or to other circuit boards, known as daughter boards, which contain circuitry and components. Data transfer speeds for backplanes have increased as backplane technology has advanced. A few years ago, data transfer speeds of 1 Gigabit per second (Gb/s) were considered fast. These speeds have increased to 3 Gb/s to 6 Gb/s and now the industry is expecting speeds of 12 Gb/s and the like to be implemented in the next few years.

At high data transfer speeds, differential signaling is used and it is desirable to reduce the crosstalk and skew in such test signal applications to as low as possible in order to ensure correct data transfer. As data transfer speeds have increased, so has the desire of the industry to reduce costs. High speed signal transfer has in the past required the differential signal terminals to be shielded and this shielding increased the size and cost of backplane connectors because of the need to separately form individual shields that were assembled into the backplane connector.

These shields also increased the robustness of the connectors so that if the shields were to be eliminated, the robustness of the connector needed to be preserved. The use of shields also added additional cost in the manufacture and assembly of the connectors and because of the width of the separate shield elements, the overall relative size of a shielded backplane connector was large. Thus, further improvements to a connectors such as those suitable for use as a backplane would be appreciated.

SUMMARY OF THE INVENTION

The present invention accomplishes these and other objects by way of its structure. In one principal aspect, the present invention includes a backplane connector component that takes the form of a pin header having a base and at least a pair with sidewalls that cooperatively define a series of slots, or channels, each of which receives the mating portion of a wafer connector component. The base has a plurality of terminal receiving cavities, each of which receives a conductive terminal. The terminals have flat control blades and compliant tails formed at opposite ends. These contact blades and tails are offset from each other and the cavities are configured to receive them. In the preferred embodiment, the cavities are shown as having an H-shape with each of the legs of the H-shaped cavities receiving one of the terminals and the interconnecting arm of the H-shaped cavity remaining open to define an air channel between the two terminals. Such an air channel is present between pairs of terminals in each row of terminals in the horizontal direction to effect broadside coupling between the pairs of terminals.

In another principal aspect of the present invention, a plurality of wafer connector components are provided that mate with the backplane header. Each such wafer connector component includes a plurality of conductive terminals that are arranged in two vertical columns (when viewed from the mating end thereof), and the two columns defining a plurality of horizontal rows of terminals, each row including a pair of terminals, and preferably a pair of differential signal terminals. The terminals in each of the wafer connector component rows are aligned broadside together so that capacitive coupling may occur between the pairs in a broadside manner. In order to regulate the impedance of each pair of terminals, each wafer connector component includes a structure that defines an internal cavity, and this internal cavity is interposed between the columns of terminals so that an air channel is present between each of the pairs of terminals in each wafer connector component.

In another principal aspect of the present invention, the contact portions of the wafer connector component terminals extend forwardly of the wafer and are formed as bifurcated contacts that have a cantilevered contact beam structure. An insulative housing, or cover member, may be provided for each wafer connector component and in such an instance, the housing engages the mating end of each wafer connector component in order to house and protect the contact beams. Alternatively, the cover member may be formed as a large cover member that accommodates a plurality of wafer connector elements.

In the preferred embodiment of the invention, theses housings or cover members have a U-shape with the legs of the U-shape engaging opposing top and bottom edges of the wafer connector component and the base of the U-shape providing a protective shroud to the contact beams. The base (of face, depending on the point of view) of the U has a series of I or H-shaped openings formed therein that are aligned with the contact portions of the terminals and these openings define individual air channels between the contact beams so that the dielectric constant of air may be used for broadside coupling between the terminal pairs through substantially the entire path of the terminals through the wafer connector component.

In another embodiment of the invention, the internal cavity of the wafer connector component is sized to receive an insert member, and this insert member may be an engineered dielectric that has a desired dielectric constant that will influence the coupling that occurs between the pairs of terminals. In this manner, the impedance of the connector assembly may be tuned to an approximate desired level. In another embodiment, the insert is formed as part of one of the connector component halves and it extends over the inner broadside surfaces of the terminals. The other connector component half lies adjacent the first connector component half with its terminals aligned broadside with the terminals of the first connector component half.

These and other objects, features and advantages of the present invention will be clearly understood through a consideration of the following detailed description.

BRIEF DESCRIPTION OF THE DRAWINGS

In the course of this detailed description, the reference will be frequently made to the attached drawings in which:

FIG. 3 is a perspective view of the backplane connector component of the backplane connector assembly of FIG. 1;

FIG. 4 is an end view of FIG. 3 taken along the line 4-4;

FIG. 4A is a perspective view of a series of terminals used in the backplane connector member of FIG. 4 and shown attached to a carrier strip to illustrate a manner in which they are formed;

FIG. 4B is a an end view of one of the terminals of FIG. 4A, illustrating the offset configuration of the terminal;

FIG. 5A is an enlarged plan view of a portion of the backplane member of FIG. 5, illustrating the terminals in place within the terminal-receiving cavities thereof;

FIG. 5B is the same plan view of the backplane member of FIG. 5, but with the terminal-receiving cavities thereof empty;

FIG. 5C is an enlarged plan view of a portion of FIG. 5B, illustrating the empty terminal-receiving cavities in greater detail;

FIG. 5D is a an enlarged detail sectional view of a portion of the backplane member illustrating two terminals of the type shown in FIG. 4A in place therein;

DETAILED DESCRIPTION OF THE PREFERRED EMBODIMENTS

Figure 1:
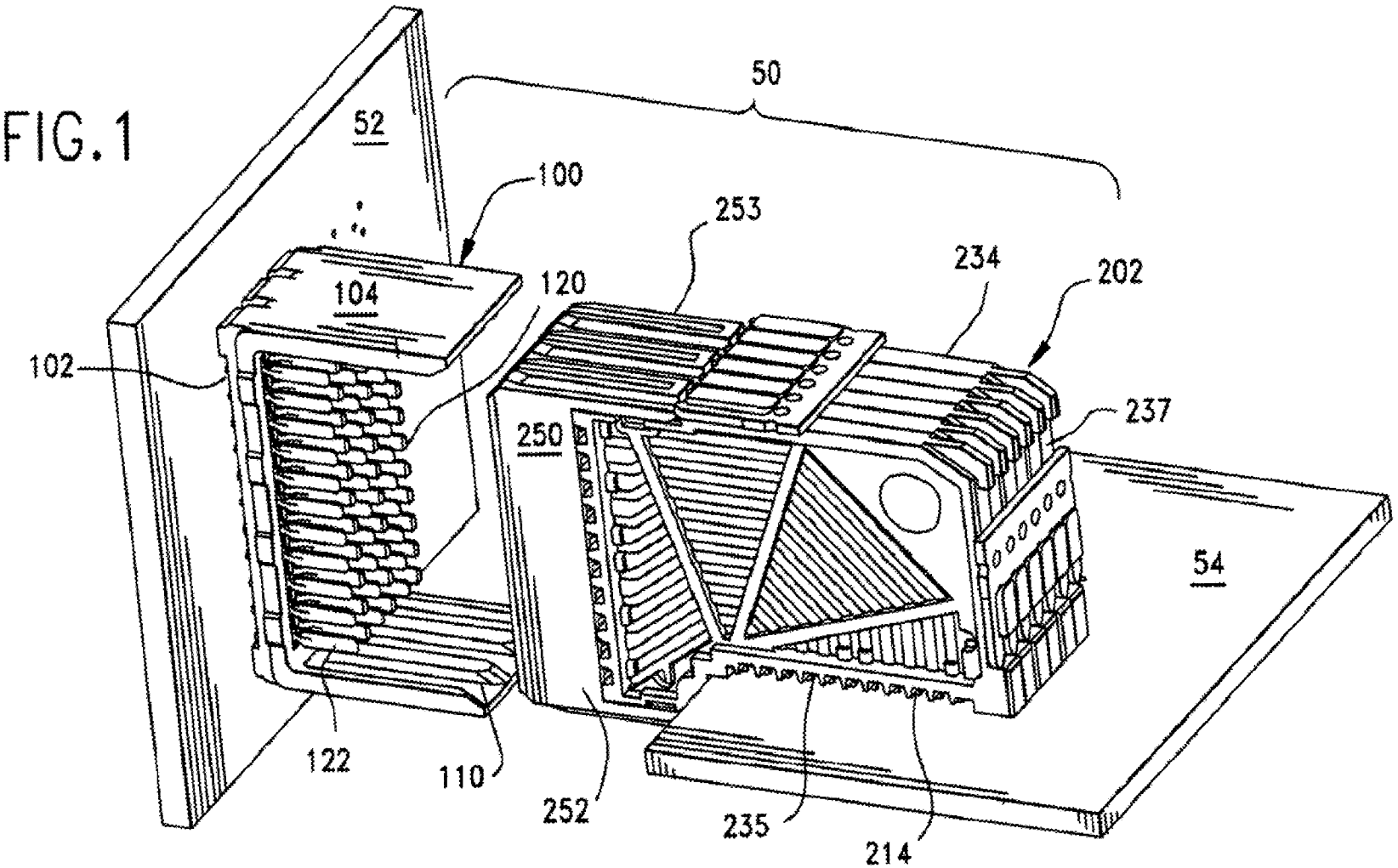
FIG. 1 is a perspective view of an embodiment of a backplane connector assembly shown in a conventional right-angle orientation.

As required, detailed embodiments are disclosed herein; however, it is to be understood that the disclosed embodiments are merely exemplary and may be embodied in various forms. Therefore, specific details disclosed herein are not to be interpreted as limiting, but merely as a basis for the claims and as a representative basis for teaching one skilled in the art to variously employ the depicted features in virtually any appropriate manner, including employing various features disclosed herein in combinations that might not be explicitly disclosed herein.

In an embodiment, a new backplane connector for use in next generation backplane applications is disclosed. The depicted connector can help provide a connector for use in connecting circuits in two circuit boards together that has a high terminal density, high speed with low crosstalk and which is robust.

In an embodiment, the connector can include a plurality of conductive terminals arranged in rows and the rows can comprise either signal or ground terminals. The rows can be held in a support structure that permits the connector to be used in right angle and orthogonal mating applications.

In an embodiment, the backplane connector assembly includes a backplane header component and a wafer connector component that is matable with the backplane header component, the backplane header component having a base that sits on a surface of a backplane and two sidewalls extending therefrom on opposite ends defining a channel into which the wafer connector component fits. The backplane header component can include a plurality of conductive terminals, each of the terminals including a flat contact blade portion, a compliant tail portion and a body portion interconnecting the contact and tail portions together so that they are offset from each other. The backplane header component can include slots associated with terminal-receiving cavities thereof, the slots providing air gaps, or channels, between the terminals through the backplane header component.

A wafer connector component can be provided in which two columns of conductive terminals are supported in an insulative support body. The body can include an internal cavity disposed between the two columns of conductive terminals, the terminal being arranged in horizontal pairs of terminal, the cavity defining an air channel between each horizontal pair of terminals arranged in the two columns of terminals, and the terminals being further aligned with each other in each row so that horizontal faces of the terminals in the two rows face each other to thereby promote broadside coupling between horizontal pairs of terminals.

As can be appreciated, wafer-like connector components can be used and each such component can be formed of two half portions with each half portion supporting an array of conductive terminals. In an embodiment, the terminals in both halves can be configured to be broadside coupled and the dielectric between them can help ensure they maintain a consistent and desirable spacing so as to provide consistent impedance values.

FIG. 1 illustrates a backplane connector assembly 50. The assembly 50 is used to join together two circuit boards 52, 54 with the circuit board 52 representing a backplane and the circuit board 54 representing an ancillary, or daughter board.

The assembly 50 can be seen to include two interengaging, or mating, components 100 and 200. One component 100 is mounted to the backplane board 52 and is a backplane member that takes the form of a pin header. In this regard, the backplane member 100, as illustrated best in FIGS. 1 and 3, includes a base portion 102 with two sidewalls 104, 106 rising up from the base portion 102. In order to facilitate the proper orientation of the wafer connector components 202 within the backplane connector component, the sidewalls 104, 106 are preferably formed with interior grooves 110 that are vertically oriented and each such groove 110 is aligned with two rows R1, R2 of conductive terminals 120 and each slot is configured to receive a single wafer connector component 202 (FIG. 3.).

As shown in FIG. 4B, the header terminals 120 are formed in an offset manner so that their contact portions 121, which take the form of long, flat blades 122 extend in one plane P1, while thin tail portions 123, shown as compliant pin-style tails 124 extend in another plane P2, that is spaced apart from the first plane P1. The terminals 120 each include a body portion 126 that is received within a corresponding terminal-recovery cavity 111 that is formed in the base portion 102 of the backplane member 100. FIG. 4A illustrates the terminals 120 in one stage as they are stamped and formed along a carrier strip 127, and it can be seen that each terminal is interconnected together not only by the carrier strip 127, but also secondary pieces 128 that hold the terminals 120 in line during their forming process. These secondary pieces 128 are removed later in the forming process as the terminals 120 are removed, or singulated and then are inserted into the base 102 of the backplane member 100, such as by stitching.

Figure 5:
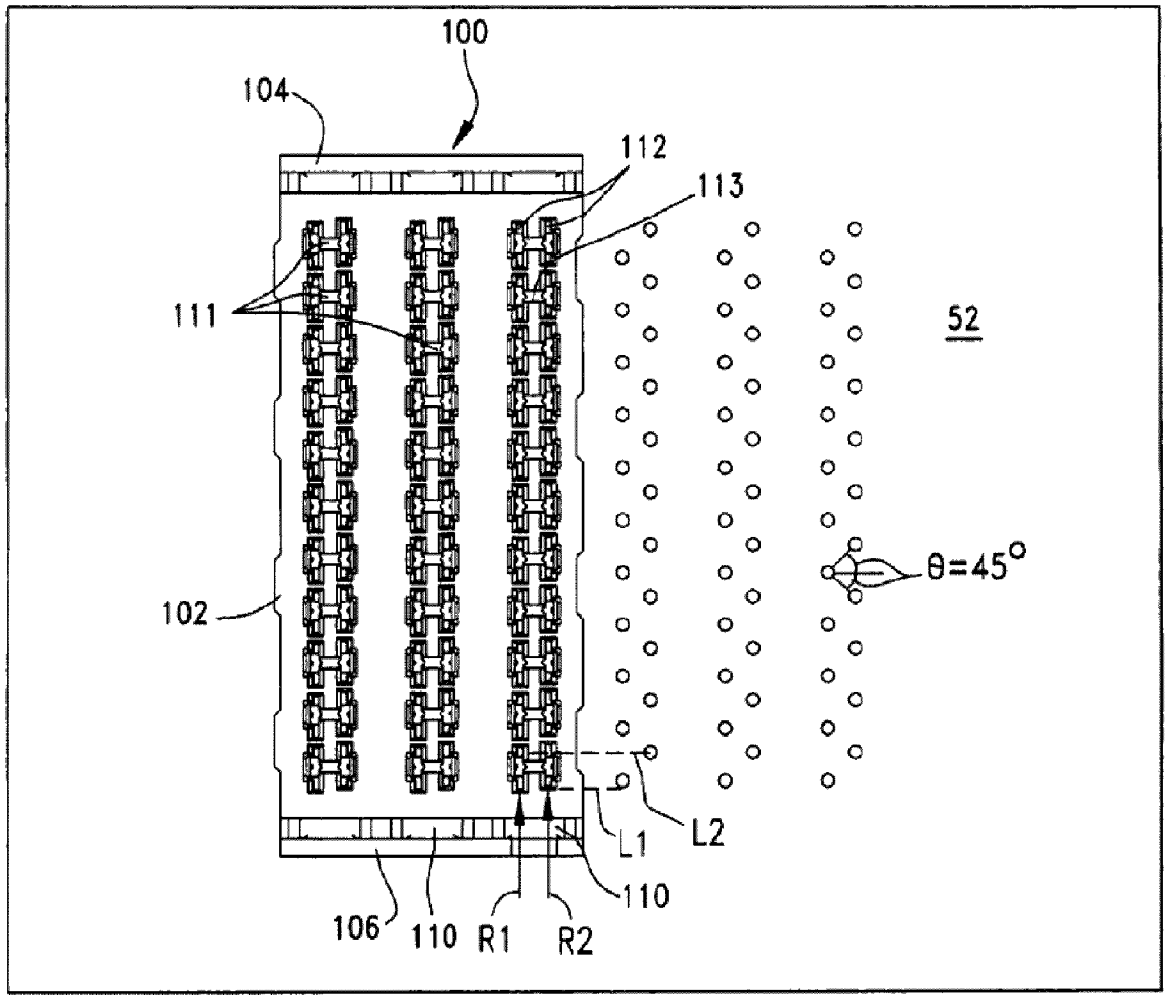
FIG. 5 is a top plan view of the backplane connector component in place on a circuit board and illustrating the tail via pattern used for such a component.

The contact blade portions 122 of the terminals 120 and their associated body portions 126 may include ribs 130 that are stamped therein and which preferably extend through the offset bends of the terminals 120. These ribs 130 serve to strengthen the terminals 120 by providing a cross-section to the terminals in this area which is better resistant to bending during insertion of the terminals 120 as well as mating with the terminals 206 of an opposing wafer connector component 202. Dimples 131 may also be formed in the terminal body portion 126 and in a manner such they project out to one side of each terminal 120 (FIG. 4B) and form a projection that will preferably interferingly contact one of the sidewalls of the terminal-receiving cavities 111 in the backplane member base portion 102. As illustrated in FIG. 5D, the backplane member base portion 102 may include a series of slots 132 formed which extend vertically and which will receive the terminal dimples 131 therein. The terminal-receiving cavities 111 are also preferably formed with interior shoulders, or ledges 134, which are best shown in FIG. 5D and which provide a surface against which the terminal body portions 126 rest.

As shown in FIG. 4A, the header terminals 120 preferably have their tail portions 123 offset as well. As shown, this offset occurs laterally of the terminals 120, so that the centerlines of the tail portions 123 are offset from the centerlines of the contact portions 121 by a distance P4. This offset permits, as clearly shown in FIG. 5, pairs of header terminal 120 to face each other and utilize the 45-degree orientation of vias shown in the right half of FIG. 5. As can be determined from FIG. 5, the compliant pin tail of one of the two rows R1 can use the bottom left via, while the compliant pin tail of the facing terminal can take the next via in the right row, and then with the pattern repeated for each pair, the vias of the header terminals, within each two rows are at 45 degree angles to each other, as shown diagrammatically to the right of FIG. 5. This facilitates the route out for such connectors on the circuit boards to which they are mounted.

As seen best in FIGS. 5A & 5C, the terminal-receiving cavities 111 of the backplane member 100 can be configured in a general H-shaped orientation, with each H-shape having two leg portions 112 that are interconnected by an arm portion 113. While the leg portions 112 of the H-shaped cavities 111 are filled with the body portions 126 of the terminals 120, the arm portions 113 of each cavity 111 remain open so that an air channel "AC" is defined in the arm portion 113 (FIG. 5A), the purpose of which will be explained in greater detail below. The spacing that results between the two terminal contact portions 122 is selected to match the approximate spacing between the two contact portions 216 of the wafer connector component terminals 206 that are received within the backplane member channels 110.

The H-shaped cavities 111 also preferably include angled edges 140 that define lead-in surfaces of the cavities 111 that facilitate the insertion of the terminals 120 therein, especially from the top side of the connector base 102. The cavities 111 include tail holes 114 that, as shown in FIG. 5A, are located at angled corners of each H-shaped opening 111. The contact blade portions 122 of the terminals 120 are located above and slightly outboard of the leg portions 112 of the H-shaped cavities 111. This is due to the offset present in their body portions 126, and this is best shown in a comparison between FIGS. 5A and 5B. FIG. 5B illustrates in an enlarged detail plan view, the backplane member base portion 102 without any terminals 120 present in the terminal-receiving cavities 111, while FIG. 5A illustrates, also in an enlarged top plan view, the terminal-receiving cavities 111 being filled with the terminals 120. In FIG. 5A, one can see that the contact blade portions extend outwardly into the areas between the rows of terminals so that the outer surfaces 124 thereof are offset from the outermost inner edges 141 of the base member terminal-receiving cavities 111.

Figure 6:
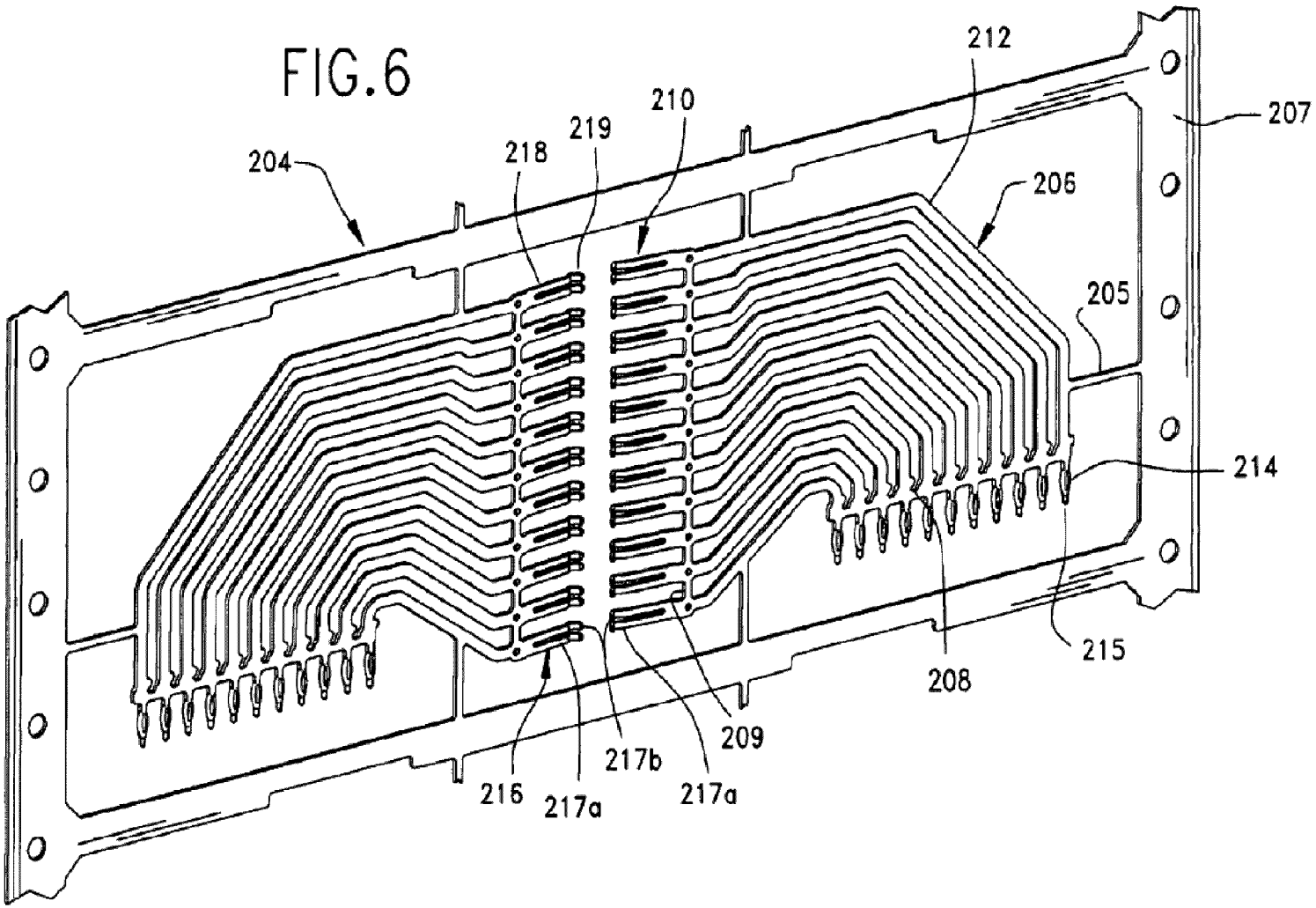
FIG. 6 is a perspective view of a stamped lead frame illustrating the two arrays of terminals that will be housed in a single wafer connector component.

FIG. 6 illustrates a metal lead frame 204 which supports a plurality of conductive terminals 206 that have been stamped and formed in preparation for subsequent molding and singulation. The lead frame 204 shown supports two sets of terminals 206, each set of which is incorporated into an insulative support half 220*a*, 220*b*, which are subsequently combined to form a single wafer connector component 202. The terminals 206 are formed as part of the lead frame 204 and are held in place within an outer carrier strip 207 and the terminals are supported as a set within the lead frame 204 by first support pieces, shown as bars 205, that interconnect the terminals to the lead frame 204 and also by second support pieces 208 that interconnect the terminals together. These support pieces are removed, or singulated, from the terminal sets during assembly of the wafer connector components 202.

Figure 7:
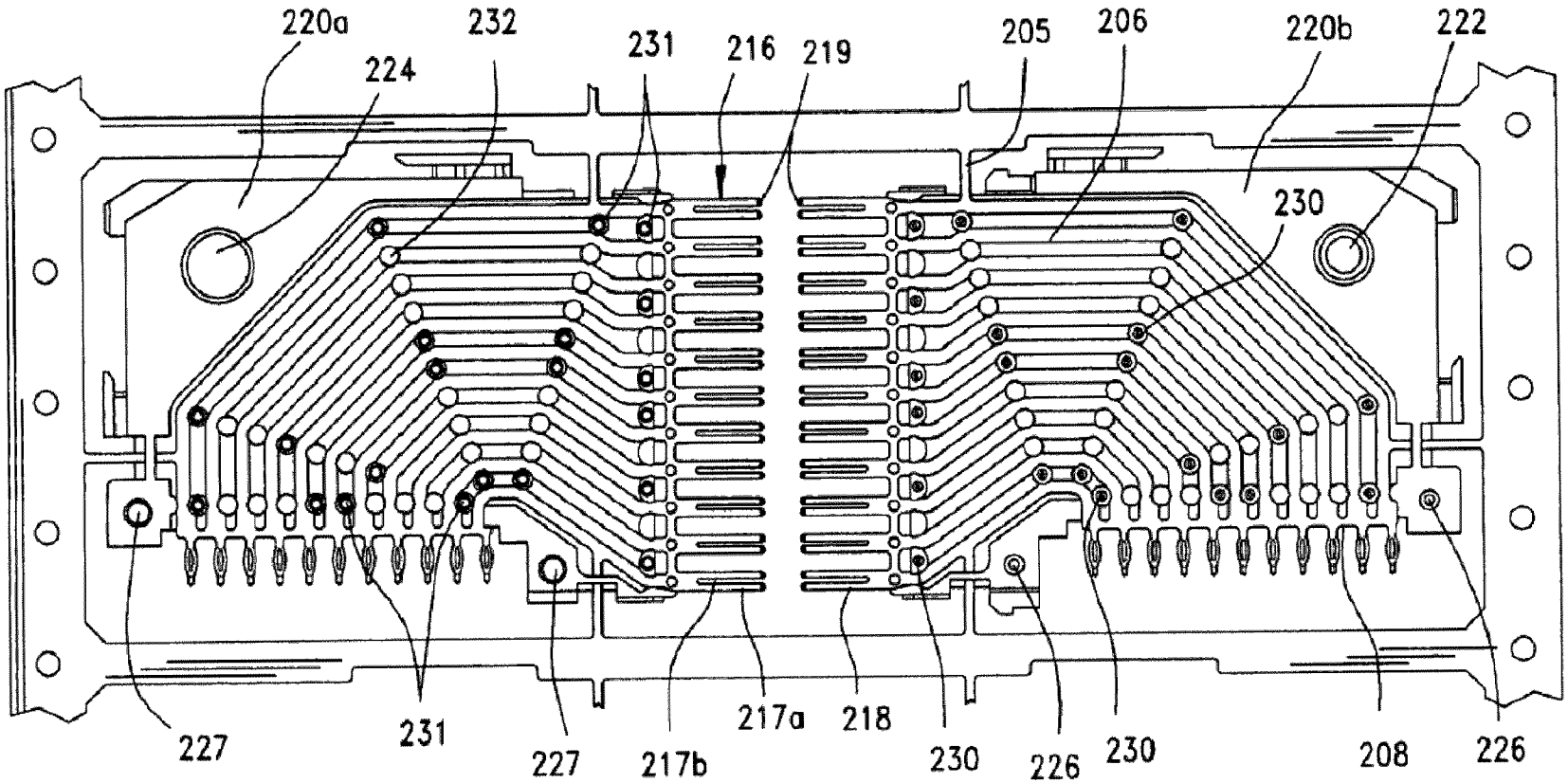
FIG. 7 is an elevational view of the lead frame of FIG. 6, taken from the opposite side thereof and showing the wafer halves formed over the terminals.

FIG. 7 illustrates the lead frame 204 with the support, or wafer halves 220*a*, 220*b* molded over portions of the set of eleven individual terminals 206. In this stage, the terminals 206 are still maintained in a spacing within the support halves by the support halve material and by the second interconnecting pieces 208, 209 that are later removed so that each terminal stands 206 by itself within the completed wafer connector component 202 and is not connected to any other terminal. These pieces 208, 209 are arranged outside of the edges of the body portions of the wafer connector component halves 220*a*, 220*b*. The support halves 220*a*, 220*b* are symmetric and are aptly described as mirror images of each other.

Figure 7A:
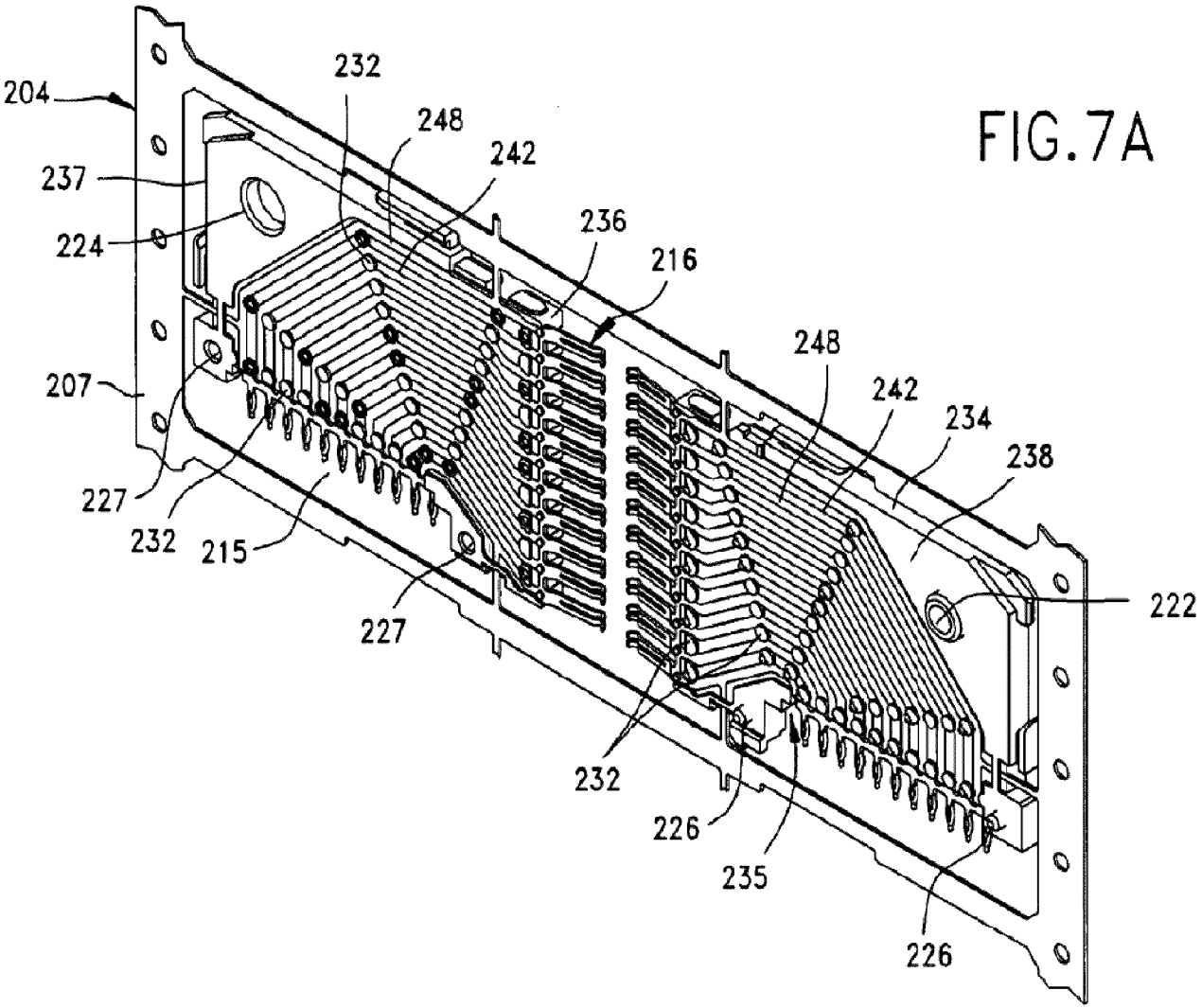
FIG. 7A is the same view of FIG. 7, but in a perspective view.

FIG. 7A illustrates best the structure which is used to connect the two wafer halves 220*a*, 220*b* together, which are shown as complimentary relatively large-shaped posts 222 and openings, or holes 224. One large post 222 and large opening 224 are shown in FIG. 7A and they are positioned within the body portion 238 of the connector component halves 220*a*, 220*b*. Three such posts 220 & 226 are shown as formed in the body portions of the wafer connector halves 220*a*, 220*b* and the other posts 230, as shown, are much smaller in size, and are positioned between selected terminals and are shown extending out of the plane of the body portion 220*b*. These posts 230 extend from what may be considered as standoff portions 232 that are formed during the insert molding process, and the standoff portions 232 serve to assist in the spacing between terminals within each wafer half and also serve to space the terminals apart in their respective rows when the halves are assembled together.

These smaller posts are respectively received within corresponding openings 231, which similar, to the posts 230, are preferably formed as part of selected ones of the standoff portions 232. In an embodiment, no housing material is provided to cover the inner faces of the terminal sets so that when the wafer connector components are assembled together, the inner vertical sides, or surfaces 247 of each pair of terminals 206 are exposed to each other. The posts and openings 230, 231 and the standoff portions 232 are cooperate in defining an internal cavity within each wafer connector component 202, and this cavity 237 is best seen in the sectional views of FIGS. 12 & 14.

Figure 8:
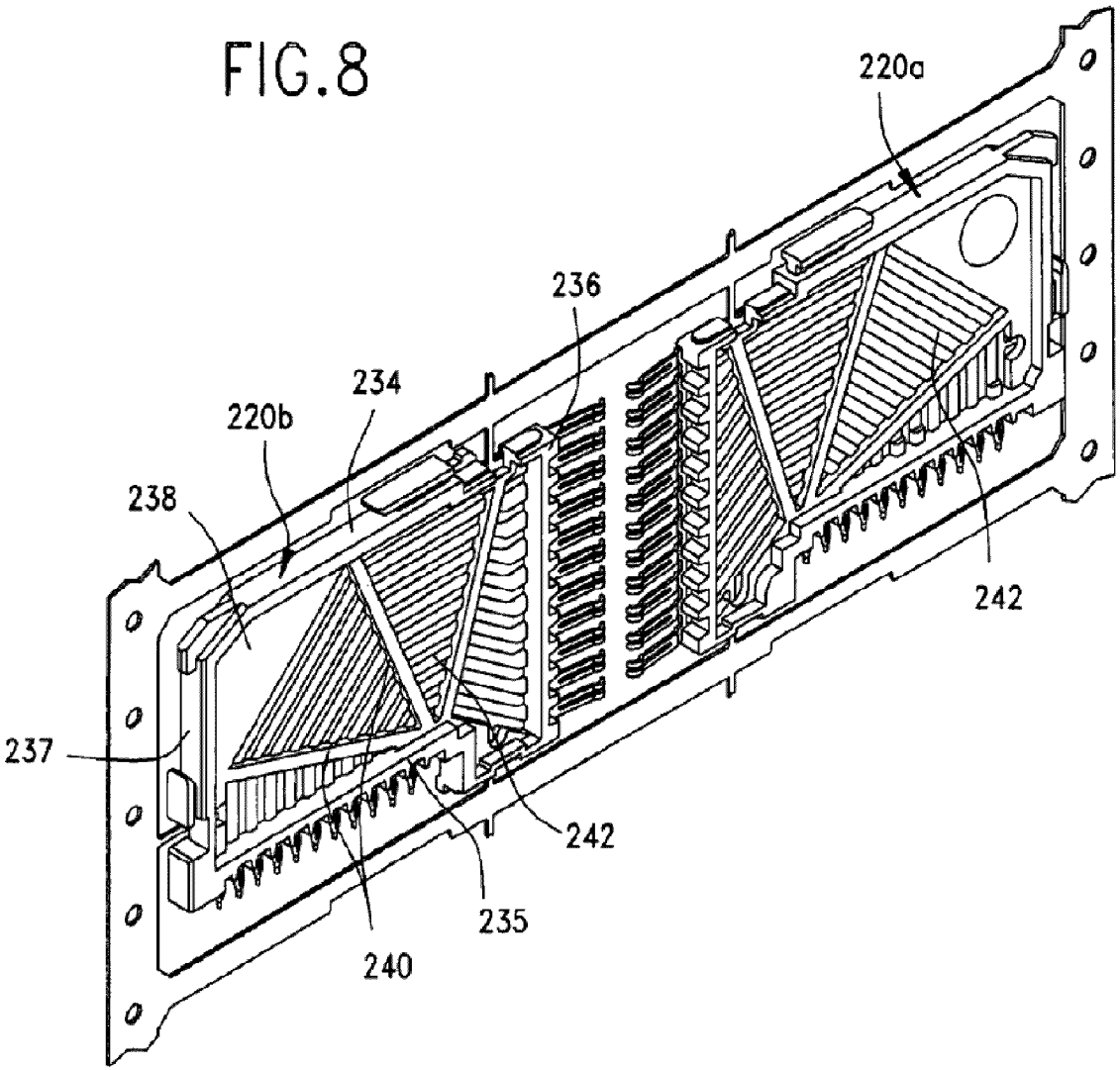
FIG. 8 is a perspective view of FIG. 7 but taken from the opposite side thereof.

FIG. 8 shows the opposite, or outer sides, of the wafer connector components and it can be seen that the wafer connector components halves 220*a*, 220*b* form what may be aptly described as a skeletal framework that utilizes structure in the form of cross braces 240 and interstitial filler pieces, or ribs 242, that extend between adjacent terminals in the vertical direction, and which preferably contact only the top and bottom edges of adjacent terminals. In this manner, the exterior surfaces 248 of the terminals (FIG. 9) are also exposed to air, as are the inner surfaces 247 of the terminals 206. These filler ribs 242 are typically formed from the same material from which the wafer connector component body portions 238 are made and this material is a preferably a dielectric material. The use of a dielectric material will deter significant capacitive coupling from occurring between the top and bottom edges 280, 281 of the terminals (FIG. 14), while driving the coupling that does occur, to occur in a broadside manner between pairs of terminals arranged horizontally.

Figure 9:
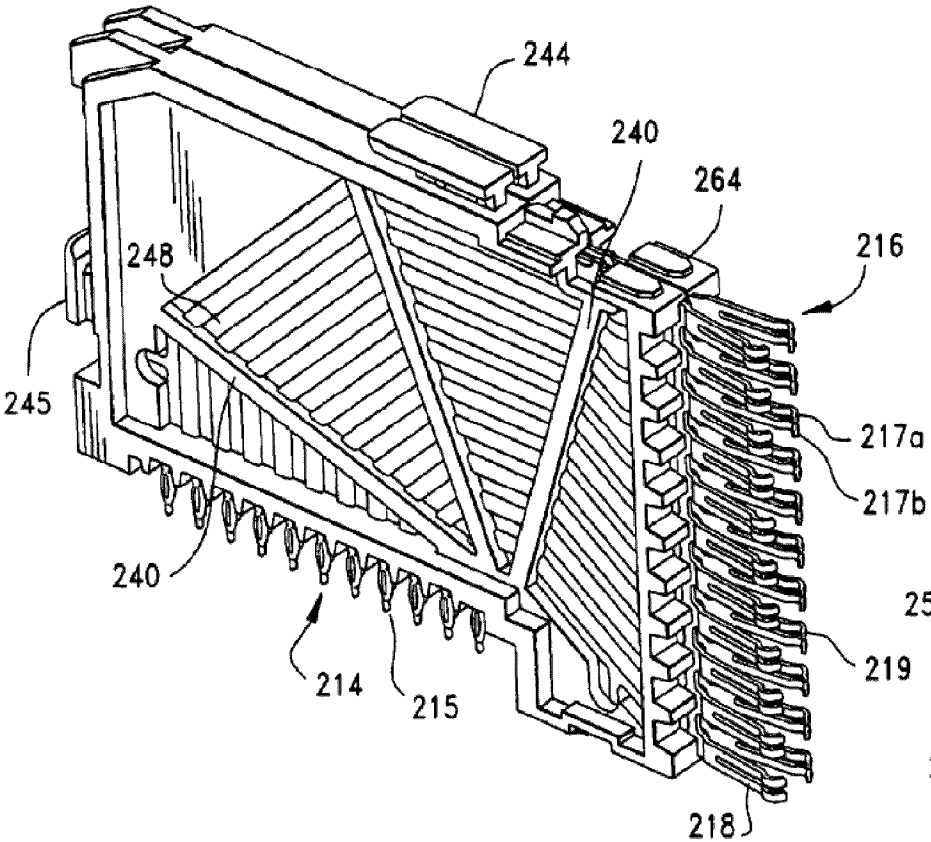
FIG. 9 is a perspective view of the two wafer halves of FIG. 8, assembled together to form a single wafer connector.
Figure 18B:
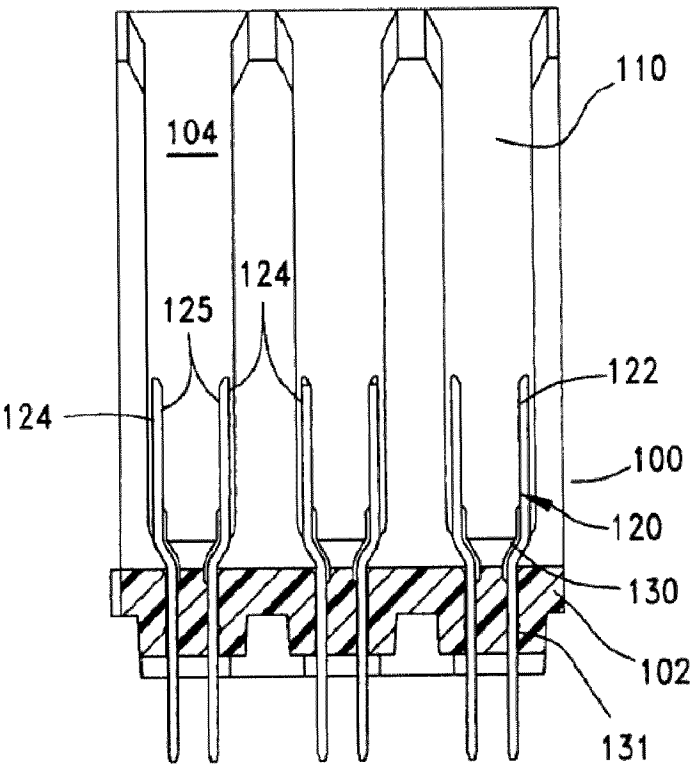
FIG. 18B is the same view as FIG. 18A, but with the wafer connector component removed from clarity.
Figure 18A:
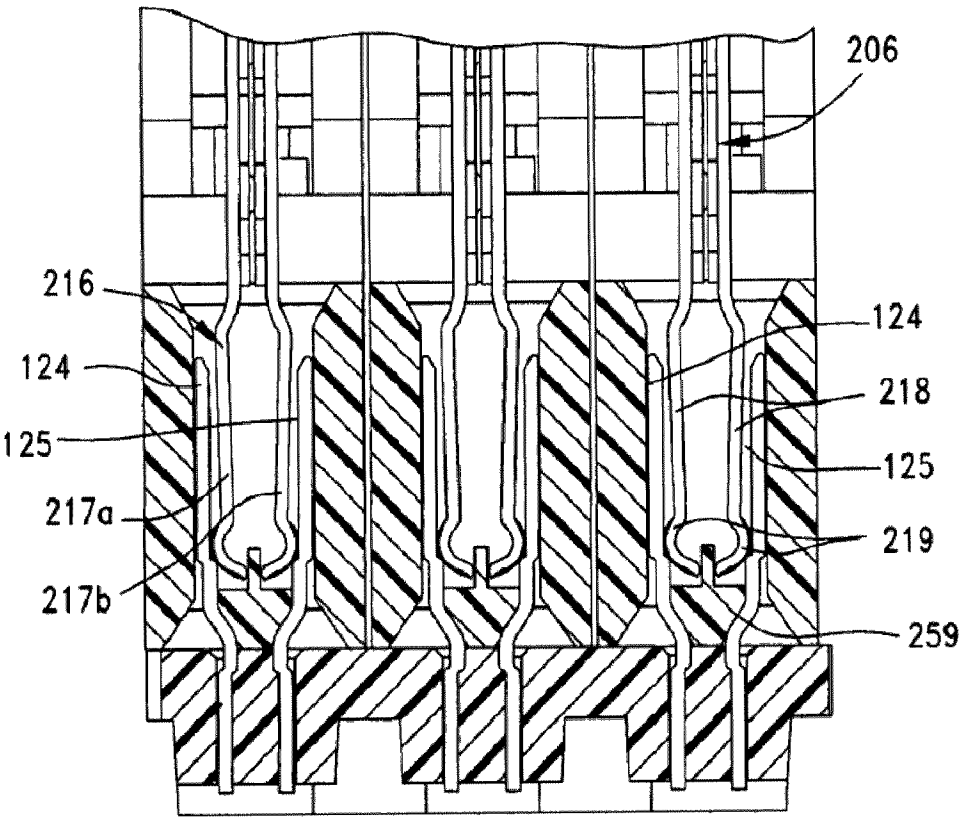
FIG. 18A is an enlarged sectional detail view of the mating interface between the wafer connector component and the backplane member, and showing the component and member.

FIG. 9 illustrates a completed wafer connector component that has been assembled from two halves. The terminals of this wafer connector component have contact and tail portions arranged along two edges and in the embodiment shown, the edges may be considered as intersecting or perpendicular to each other. It will be understood that the edges could be parallel or spaced apart from each other as might be used in an interposer-style application. The first set of contact portions 216 are the dual beam contact portions 217*a*, 217*b* that are received in the central portion of the backplane member 100 of the assembly, while the second set of contact portions 214 serve as tail portions and as such, utilize compliant pin structures 215 so that they may be removably inserted into openings, or vias, of circuit boards. The contact portions 216 of the wafer connector component 202 are formed as dual beams 217 and they extend forwardly of a body portion of each terminal. The ends of the terminal contact portions 216 are formed into curved contact ends 219 that are at the ends of the bodies 218 of the contact beams. These curved ends 219 face outwardly so that they will ride upon and contact the flat blade contacts 122 of the backplane member terminals 120. (FIG. 18A.)

Figure 19:
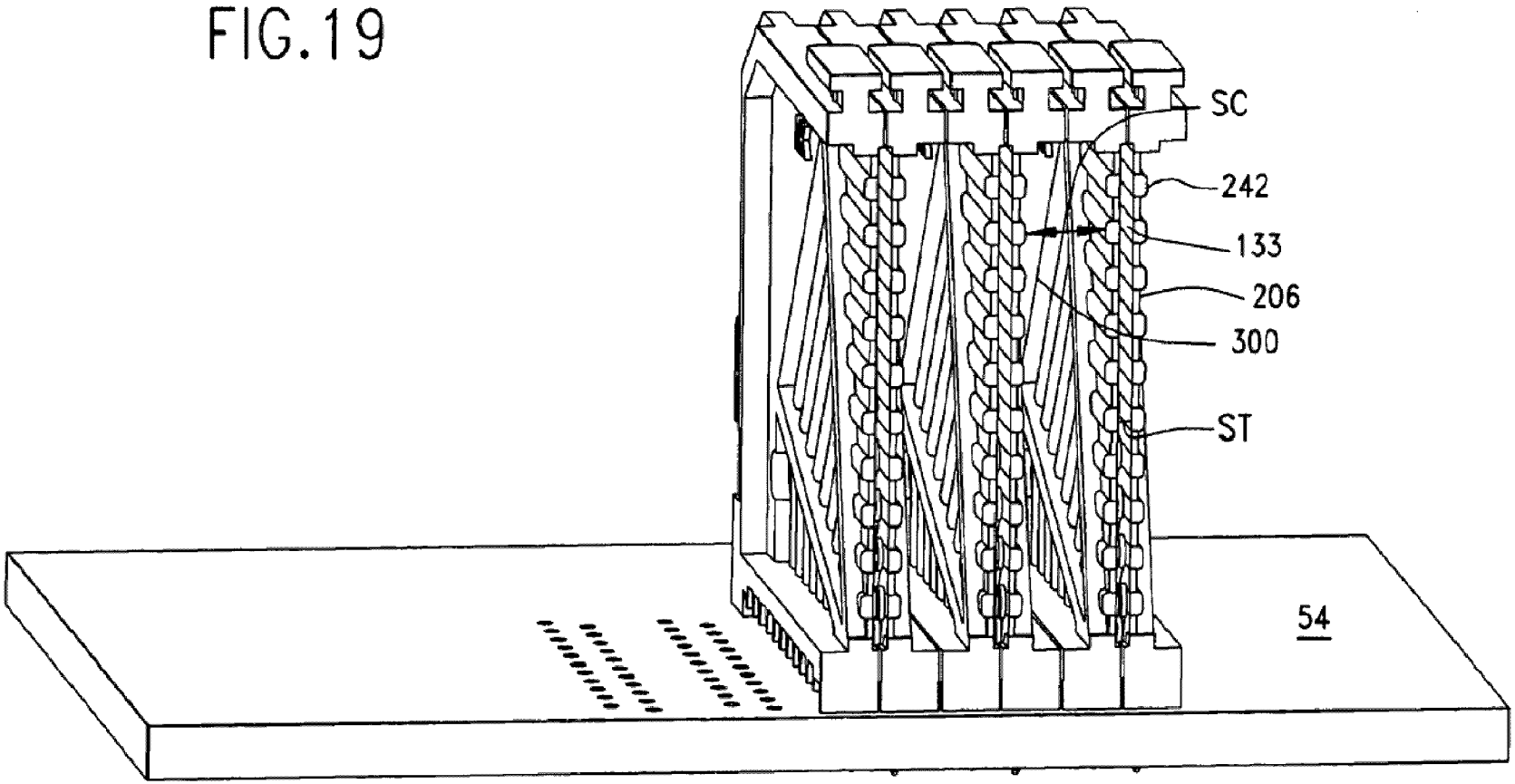
FIG. 19 is an angled end sectional view of three wafer connector components in place upon a circuit board, illustrating the air gaps between adjacent signal pairs and the air gap between adjacent wafer connector components.
Figure 20:
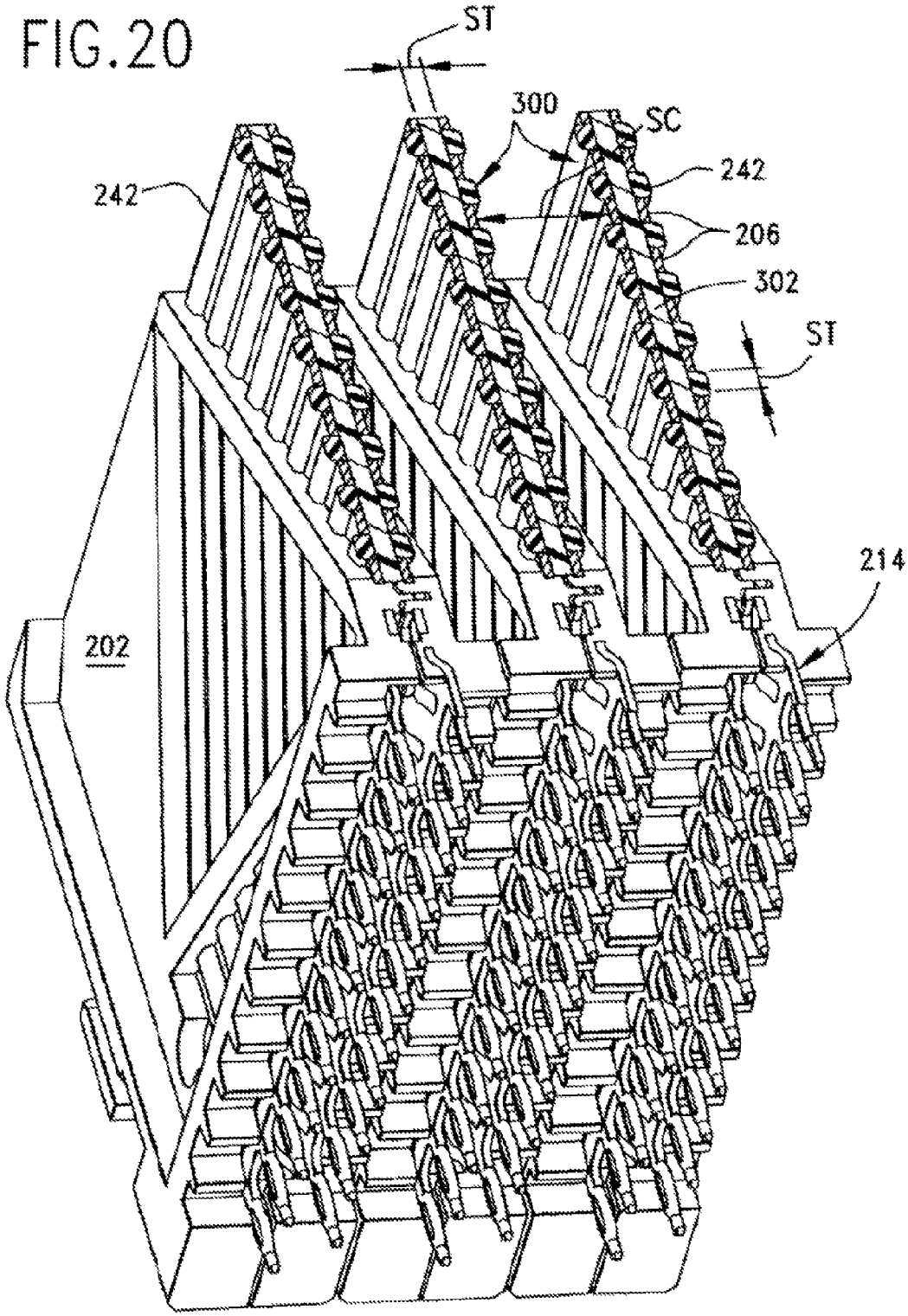
FIG. 20 is a partial sectional view of an alternate embodiment of a set of backplane connector assembly wafer connector components with a dielectric insert in their internal cavities.

When assembled together as a unit of wafers, there is present not only the air channel 133 between the terminals 206 within each wafer connector component 202, but also an air spacing 300 between adjacent wafer connector components, as shown in FIG. 19. The terminals are preferably spaced apart a first preselected distance ST uniformly through out the connector assembly, which defines the dimension of the air channel. This spacing is between designated pairs of terminals in each of the connector elements and this spacing is the same on an edge-to-edge basis within each connector element. Preferably, the spacing SC between connector elements, is greater than the spacing ST. (FIGS. 19 & 20.) This spacing helps create isolation between wafer connector elements.

Figure 10:
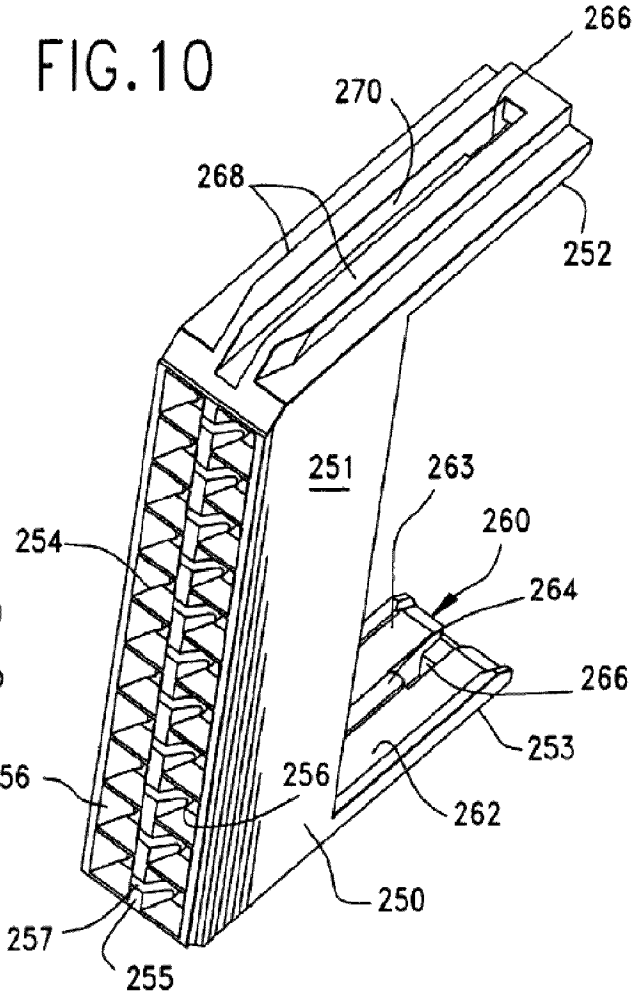
FIG. 10 is a perspective view of a cover member used with the wafer connector of FIG. 9.
Figure 10A:
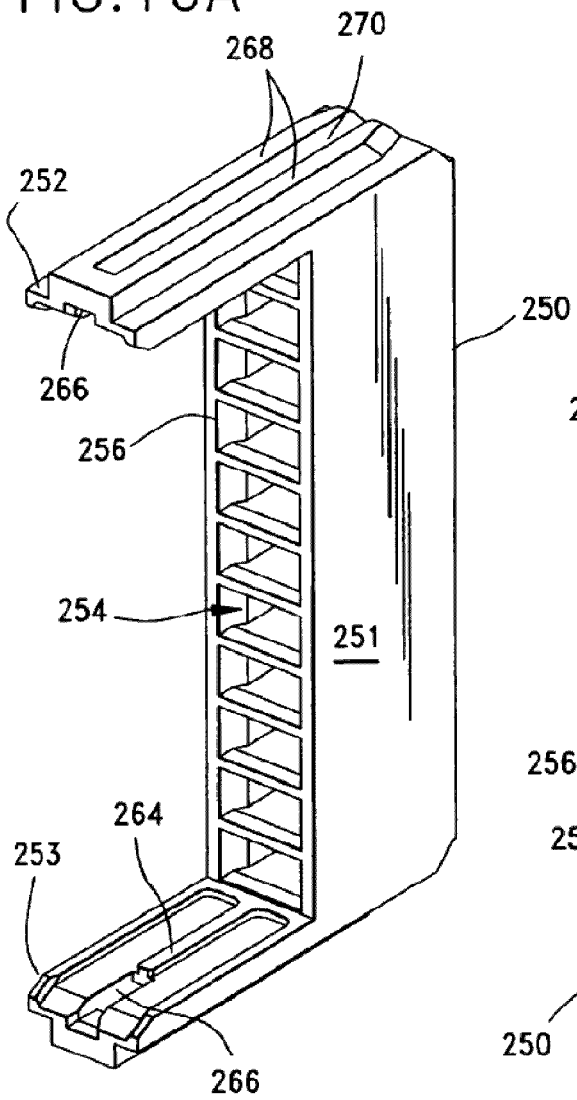
FIG. 10A is the same view as FIG. 9, but taken from the opposite side and illustrating the interior of the cover member.
Figure 11:
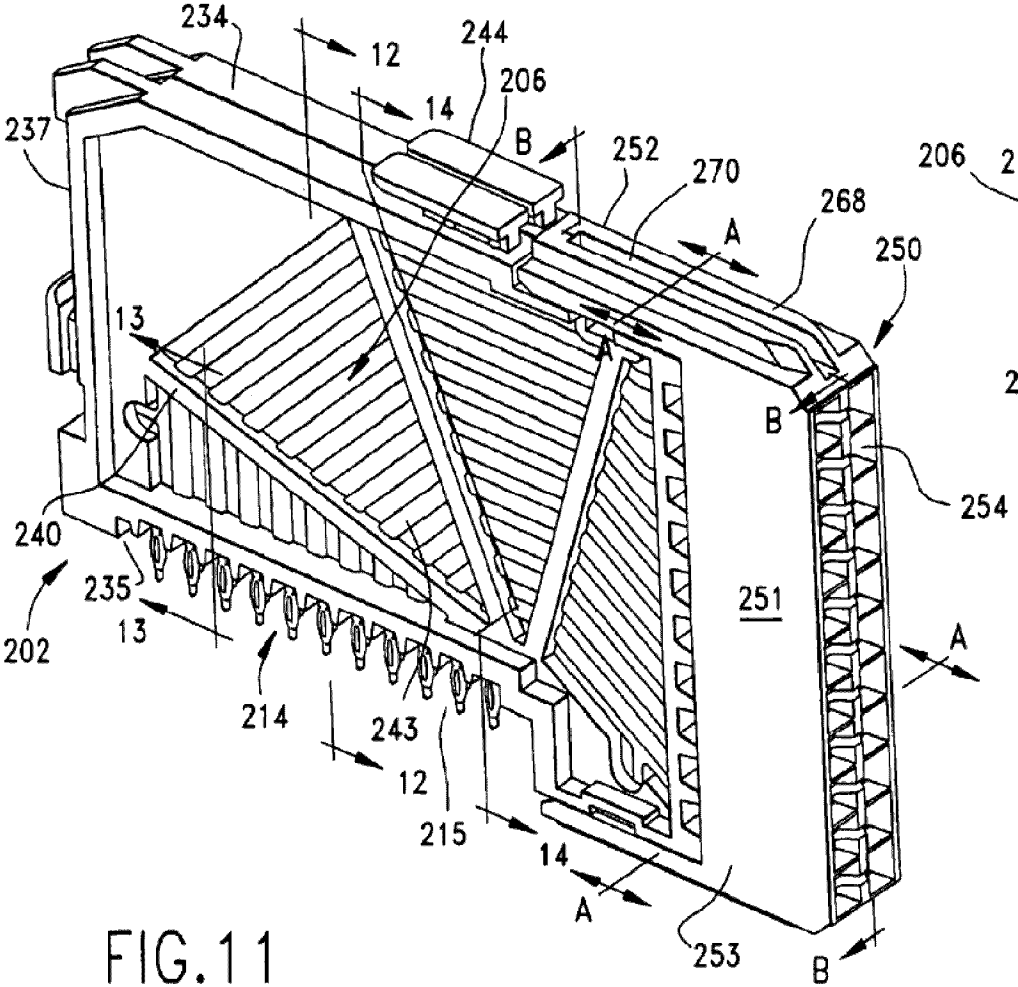
FIG. 11 is the same view as FIG. 9, but with the cover member in place to form a completed wafer connector component.
Figure 11A:
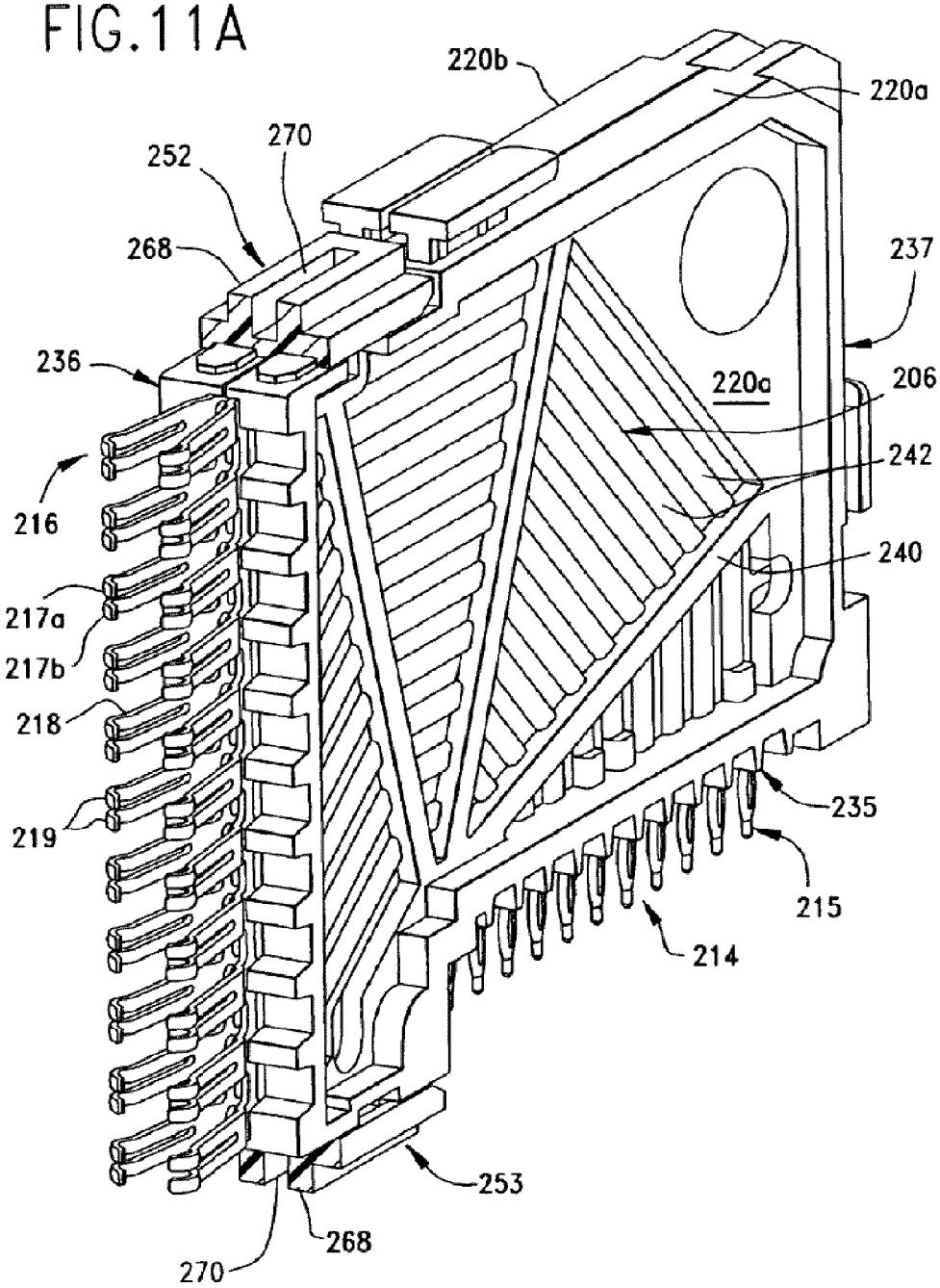
FIG. 11A is a sectional view of the wafer connector component FIG. 11, taken from the opposite side and along lines A-A of FIG. 1, with a portion of the cover member removed for clarity.

A cover member 250 is utilized to protect the dual beam contacts 217*a*, 217*b* and such a cover member 250 is shown in FIGS. 10A through 11 as one of a construction that covers the front end of only a single wafer connector element. The cover member 250 is shown in place upon the wafer connector component 202 in FIG. 11, and it serves as a protective shroud for the dual beam contacts 217*a*, 217*b*. The cover member 250 is preferably molded from an insulative material, such as a plastic that also may be chosen for a specific dielectric property. The cover member 250 has an elongated body portion 251 that extends vertically when applied to the wafer connector component 202 and the body portion 251 includes spaced-apart top and bottom engagement arms 252, 253. In this manner, the cover member 250 has a general U-shape when viewed from the side, and as illustrated in FIG. 10, it generally fits over the contact portions 216 of the terminals 206 of the wafer connector components 202, while the arms 252, 253 engage the wafer connector component 202 and serve to hold it in place.

Figure 10B:
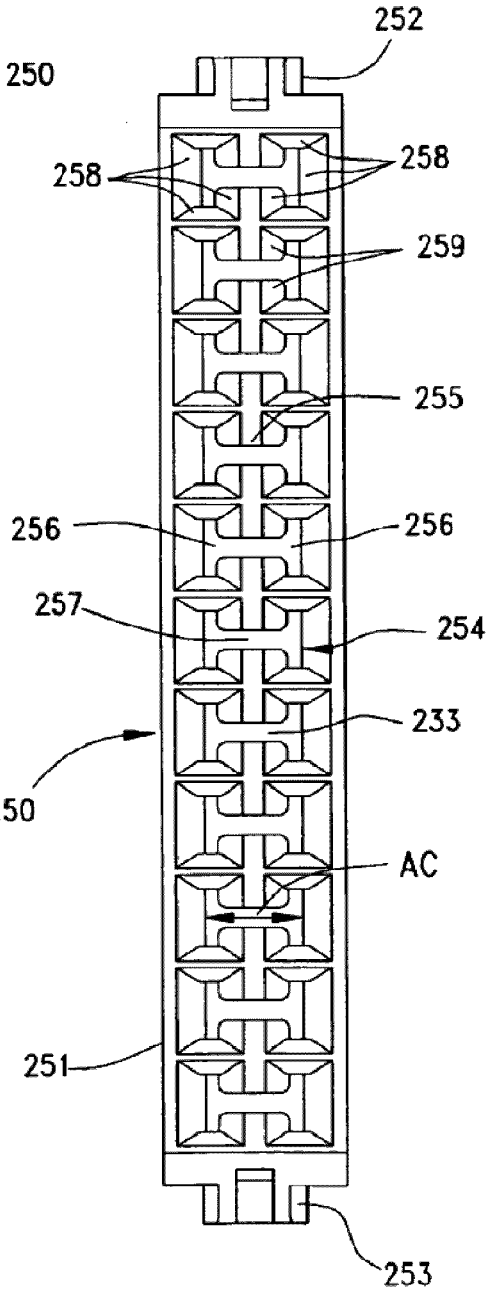
FIG. 10B is a front elevational view of the cover member of FIG. 10, illustrating the I-shaped channels of the mating face thereof.
Figure 10C:
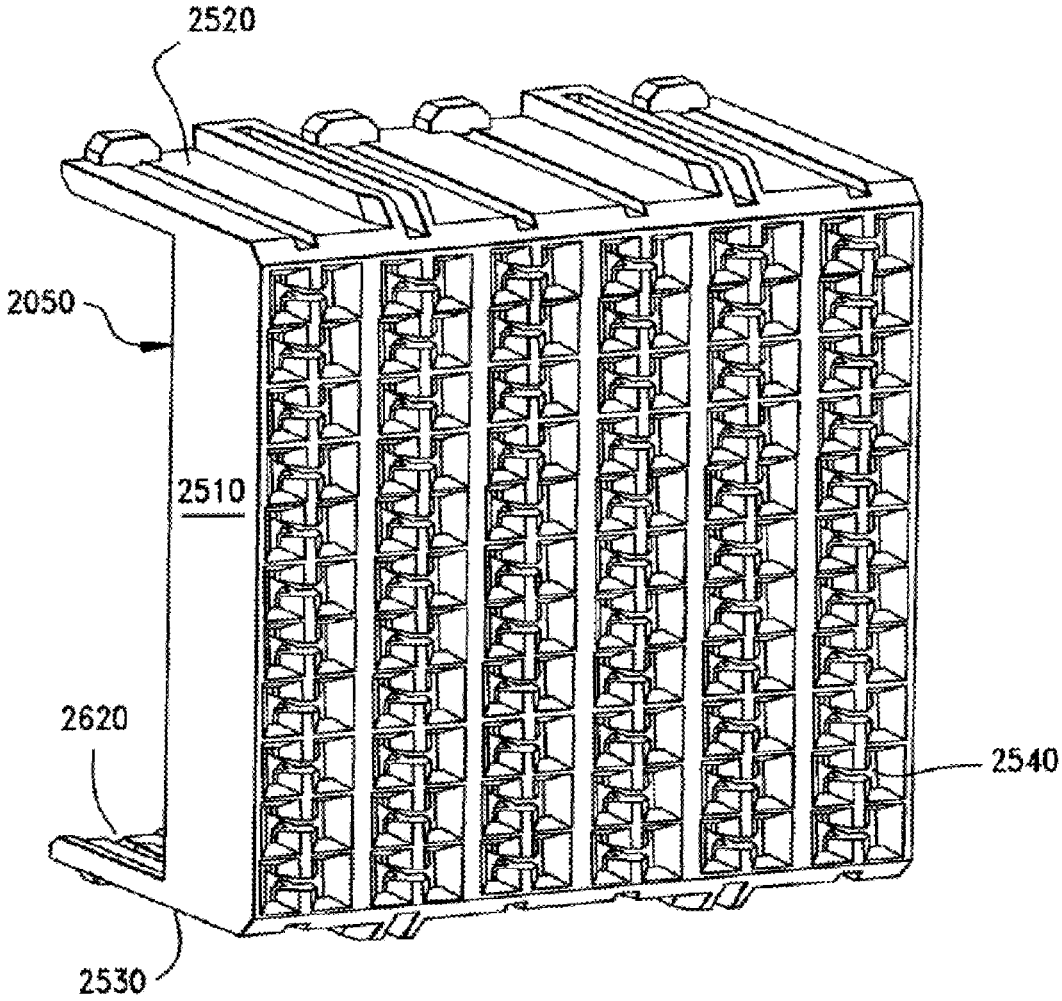
FIG. 10C is a perspective view of an embodiment of a 6-row cover member similar to the cover member depicted in FIG. 10.
Figure 13A:
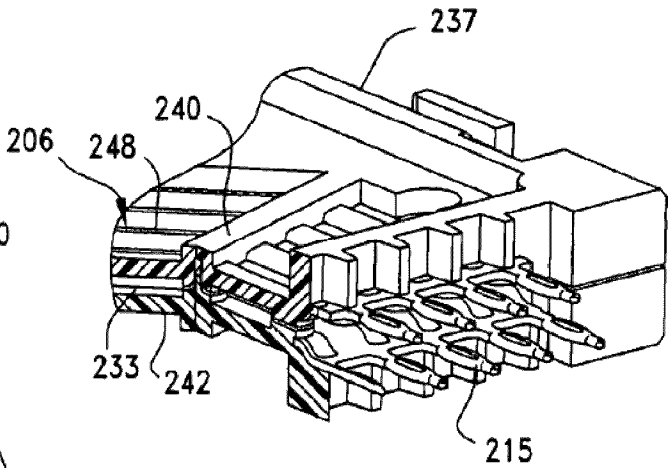
FIG. 13A is a partial sectional view of the wafer connector component of FIG. 11, taken along the angled line 13-13 thereof.

The cover member 250 is formed with a plurality of cavities, or openings 254, and these are shown best in FIGS. 10A and 10B. The cavities 254 are aligned which each other in side-by-side order so that they accommodate a horizontal pair of terminal contact portions 216 of the wafer connector component 202. The cover member 250 may also include various angled surfaces 258 that serve as lead-ins for the terminals 120 of the backplane member 100. As shown best in FIG. 10B, each such cavity 254 has a general H-shape, with the dual beam contacts 216 being received in the leg portions 256 of the H-shape. The leg portion openings 256 are interconnected together by intervening arm portions 257 of the H-shape, and these arm portions 257 are free of any terminal or wafer material so that each one acts as an air channel AC that extends between opposing surfaces of the dual beam contacts 217. As is the case with the backplane member H-shaped cavities 111, the cavities 254 of the cover member 250 also permit broadside coupling between the terminal contact portions 216 of the wafer connector component. FIG. 10C illustrates a cover member 2050 that is wider than just a single connector wafer element as in FIGS. 10-10B. This cover member 2050 includes internal channels 2620 formed in the interior surfaces of the end walls 2520, 2530 which extend between the side walls 2510 thereof. The cover member 2050 includes the H-shaped openings 2540 and angled lead-in surfaces in the same fashion as those shown and described for the cover member 250 to follow.

Figure 12:
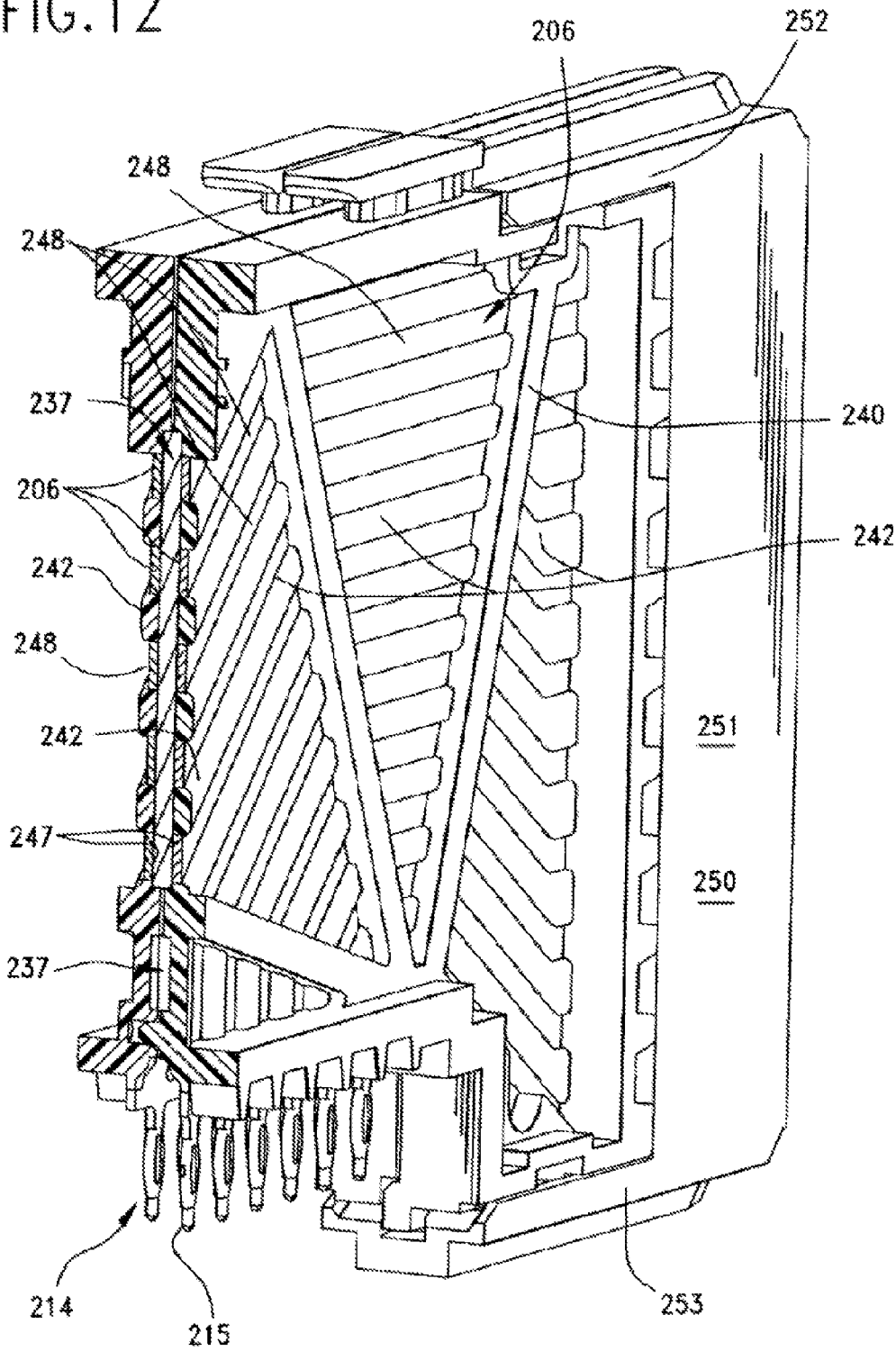
FIG. 12 is a sectional view of the wafer connector component of FIG. 11, taken along the vertical line 12-12 thereof.

In this manner, the air channel AC that is present between horizontal pair of terminals 206 (and which is shown in FIG. 12) of the wafer connector component 202 is maintained through the entire mating interface from the connector element tail portions mounted to the circuit board, through the wafer connector component, and into and through the backplane or header connector. It will be appreciated that the air channels 257 of the cover member cavities 254 are preferably aligned with the air channels 113 of the backplane member cavities 111.

Figure 11B:
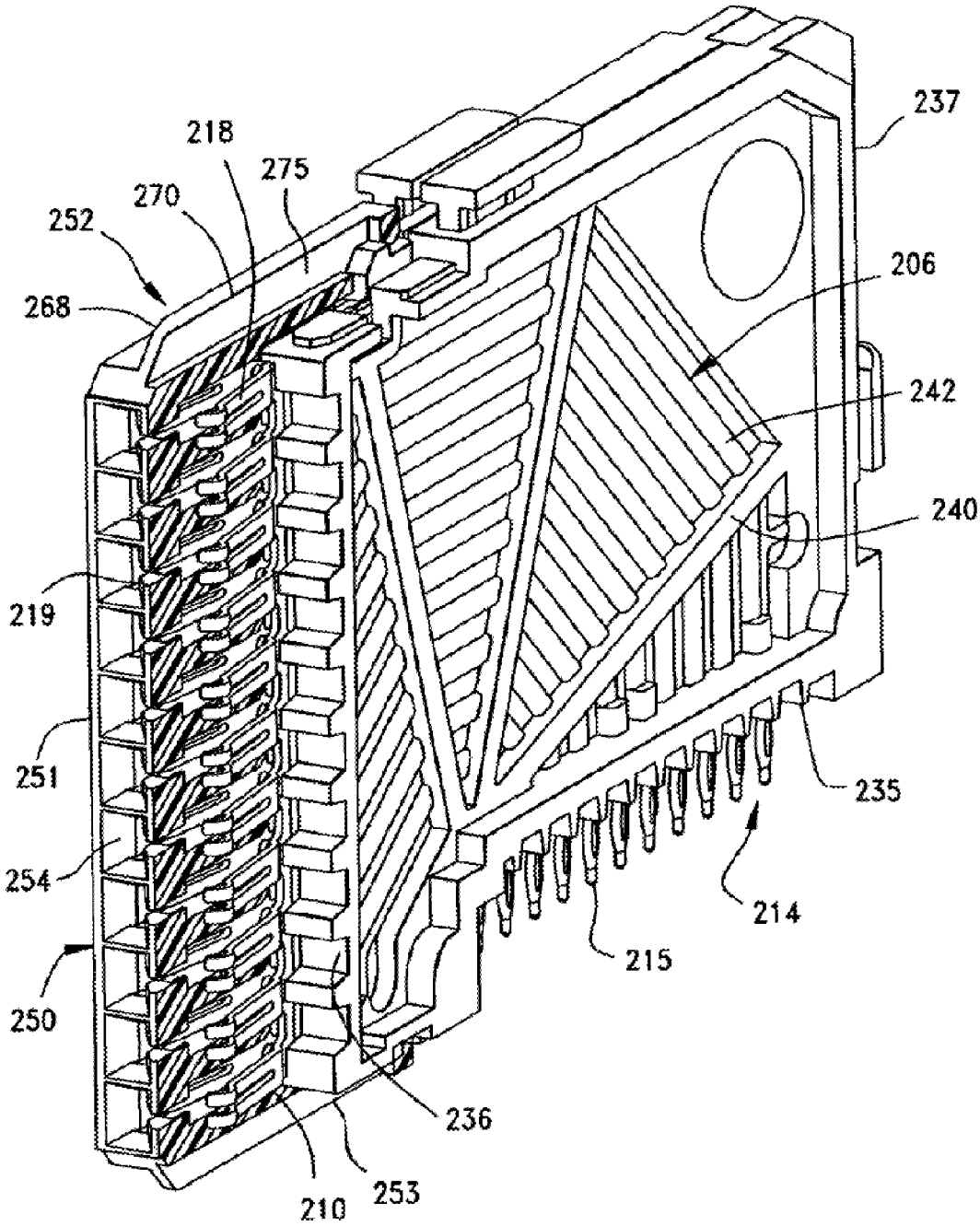
FIG. 11B is the same perspective view as FIG. 11, taken from the opposite side and sectioned along lines B-B of FIG. 11, illustrating how the terminal contact portions are contained within the interior cavities of the cover member.

As can be appreciated from FIGS. 10A-10C, the cover member 250 may include a pair of channels 262, 263 that are disposed on opposite sides of a central rib 264 and which run for the length of the cover member 250. These channels 262, 263 engage and receive lugs 264 that are disposed along the top edge of the wafer connector component 202. The cover member arms 252, 253 also may contain a central slot 275 into which extends a retaining hook 276 that rises up from the top and bottom edges 234, 235 of the wafer connector component. The manner of engagement is illustrated in FIG. 11B and the cover member arms 252, 253 may be snapped into engagement or easily pried free of their engagement with the wafer connector component 202.

FIGS. 15-18B illustrates the mating interface between the two connector components and it can be seen that the forward portion of the cover members 250 fit into the channels 110 of the backplane member 100. In doing so, the blade contact portions 122 of the backplane member terminals 120 will enter the cover member cavities 254 and the distal tips, i.e. the curved ends 219, of the dual beam contacts 217 will engage the inner surfaces 125 of the pairs of backplane member terminals 120. The backplane member terminal blade contact portions will then flex slightly outwardly against the inner walls of the cover member 250 and this contact ensures that the contact blades 122 will not deflect excessively. Additionally, the cover member 250 includes central walls 259 that flank the center air channel slots 257 and these walls 259 are angled and their angled surfaces meet with and contact the offset which is present in the backplane member terminal body portions 126. The ribs 130 of the terminal body portions 126 of the backplane member terminals 120 may be aligned with the air channel slots 257.

Figure 13B:
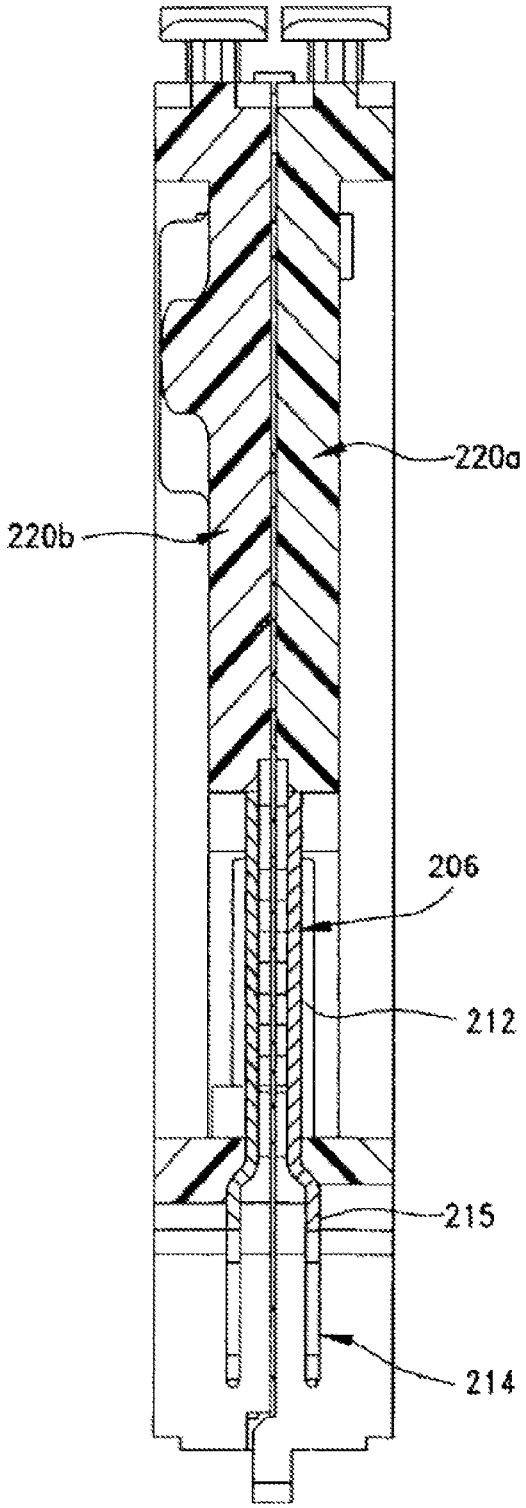
FIG. 13B is the same view as FIG. 13A, but taken directly from the front of the section shown in FIG. 13A.
Figure 14:
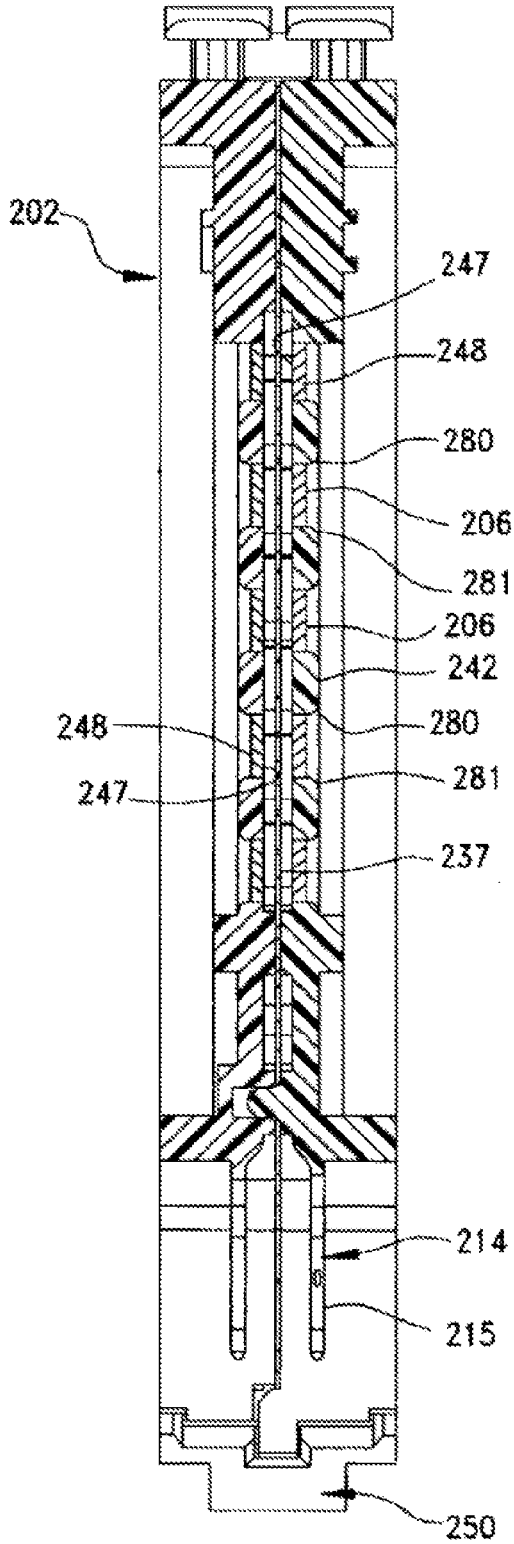
FIG. 14 is a sectional view of the wafer connector component of FIG. 1, taken along vertical line 14-14 thereof.
Figure 15:
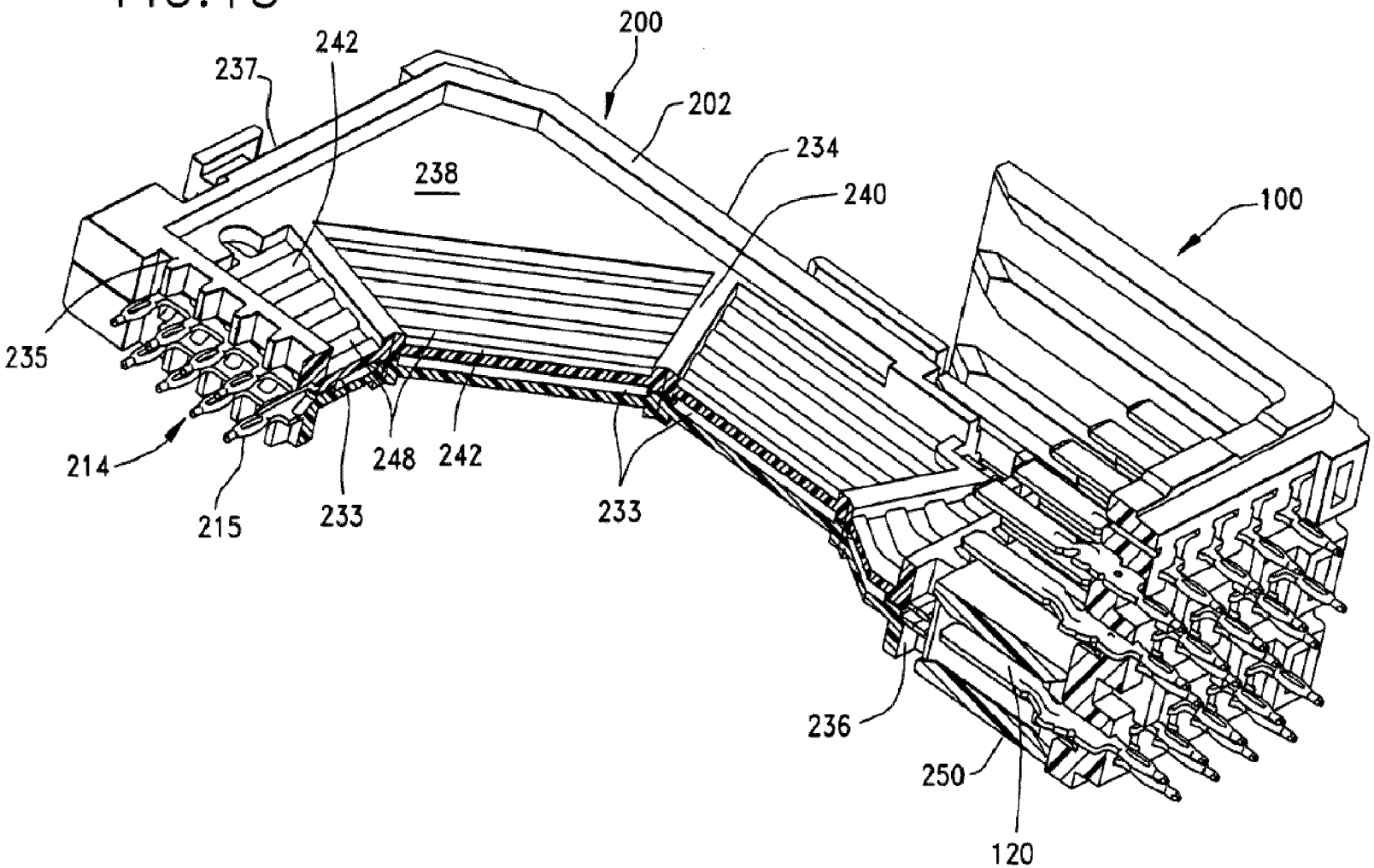
FIG. 15 is a perspective view, partly in section of a wafer connector component and backplane member mated together.
Figure 17:
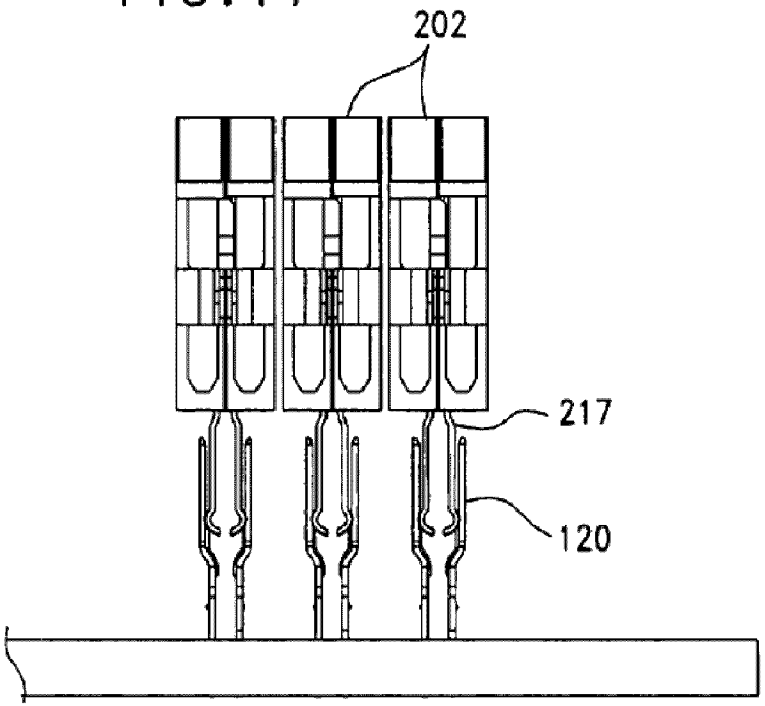
FIG. 17 is a similar view to FIG. 16, but with the wafer connector component terminals being supported by their respective connector component supports.
Figure 16:
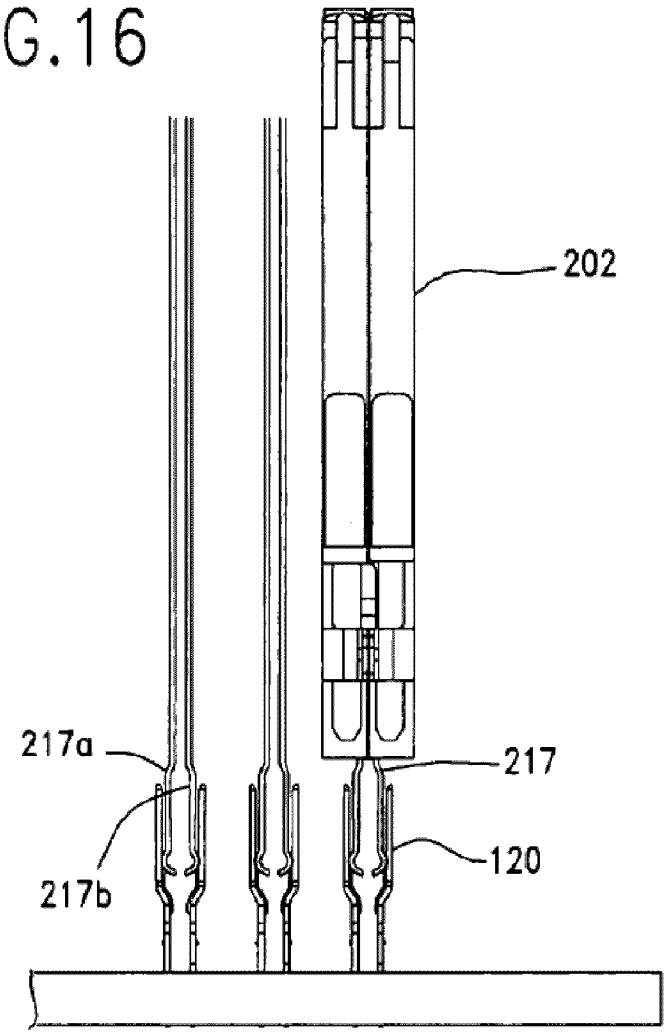
FIG. 16 is an end diagrammatic view of the wafer connector component and backplane member mated together with the cover member removed for clarity.

FIGS. 13B and 14 illustrates how the compliant portions 215 of the wafer connector component connector terminal tail portions 214 are spaced further apart in the tail area than in the body of the wafer connector component 202. The tail portions 214 are offset and the space between adjacent pairs of tails is left empty and is therefore filled with air. No wafer material extends between the pairs of terminal tails 214 so that the air gap that is present in the body of the wafer connector components is maintained at the mounting interface to the circuit board.

Figure 2:
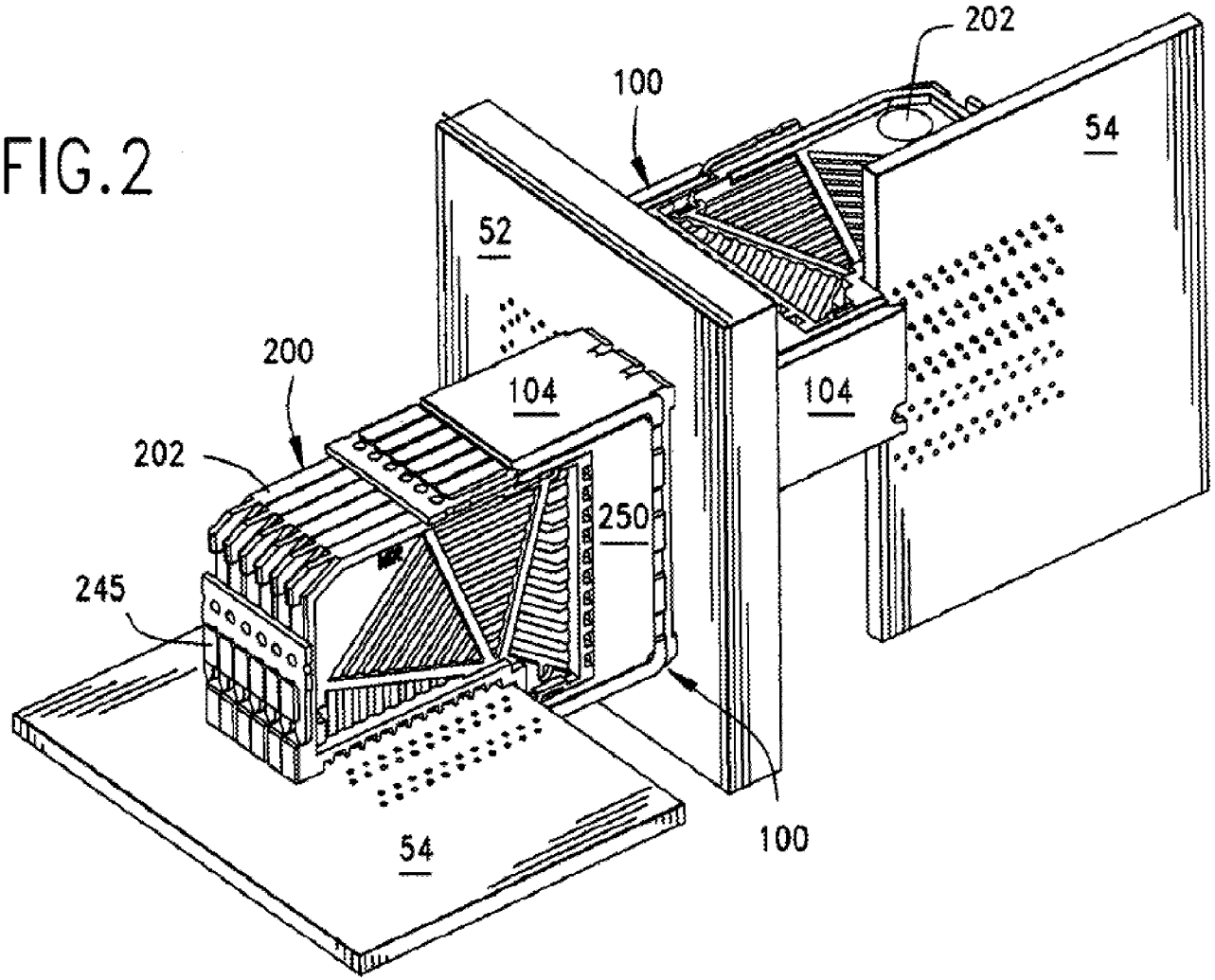
FIG. 2 is a perspective view of two backplane connectors used in an orthogonal orientation to join circuits on two circuit boards together.

The terminal tails 214 are also offset in their alignment and this offset only encompasses the compliant tail portions 215. The legs of the H-shaped cavities 111 can be seen in FIG. 5A as including a slight offset. This is so that the terminals 120 need be only of one shape and size, and one row may be turned 180 degrees from the other row of terminals and inserted into the cavities 111. The body portions 126 and the blade contact portions 122 are not offset so the offset of the leg portions 126 of the terminal-receiving cavities 111 ensures that the flat contact blade and the (offset parts of the) body portions are aligned with each other to maintain coupling. Secondly, the tails are then offset from each other by about 45 degrees. This permits the use of a favorable via pattern on the mounting circuit board and permits the connector assembly to be used in orthogonal midplane applications, such as is shown in FIG. 2.

In another embodiment, and as illustrated in FIG. 20, an insert member 302 having a specific dielectric constant may be provided and inserted into the internal cavity 133 of each wafer connector component 202. The interconnecting pieces 208 between the tail portions have not been removed in this Figure, and in operation they would be removed prior to assembly of the wafer halves into a single connector component and assembly of a group of connector elements together.

Figure 21:
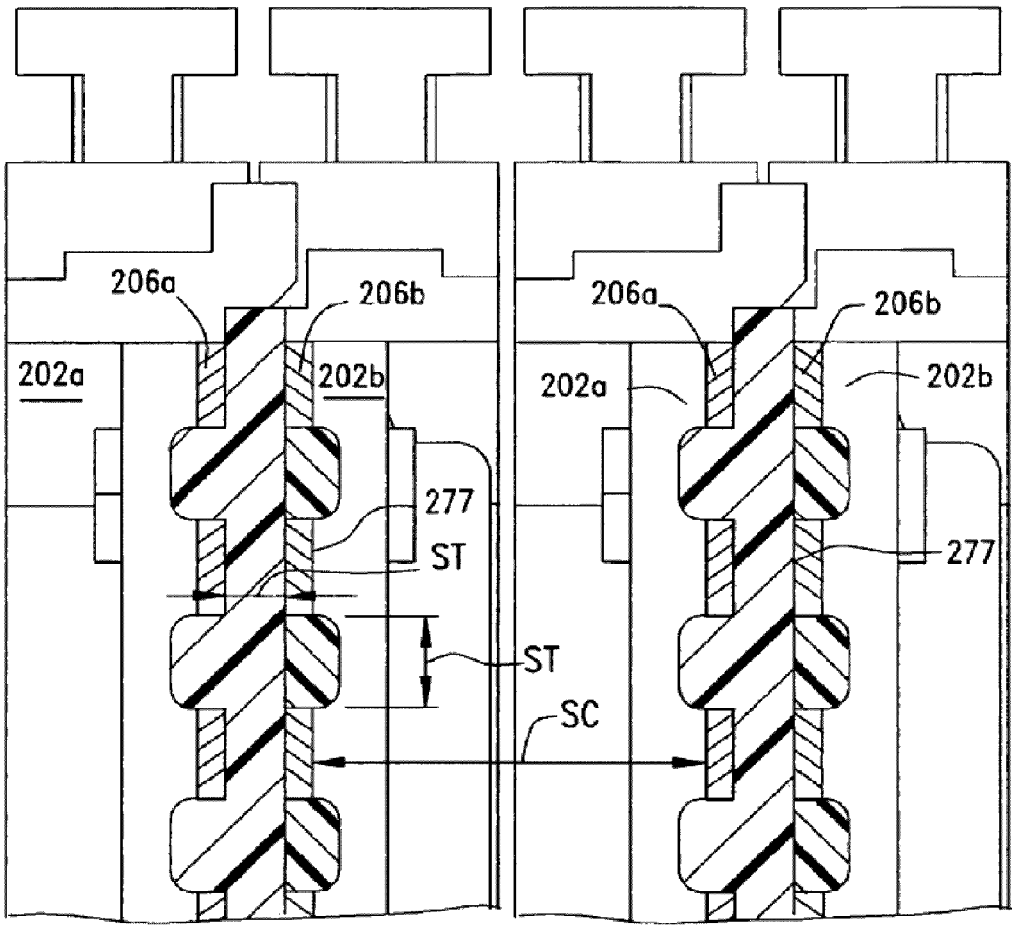
FIG. 21 is a partial sectional view of another embodiment of a set of wafer connector components with a dielectric material between the two columns of terminals but with the material being formed from one of the connector component halves.
Figure 22:
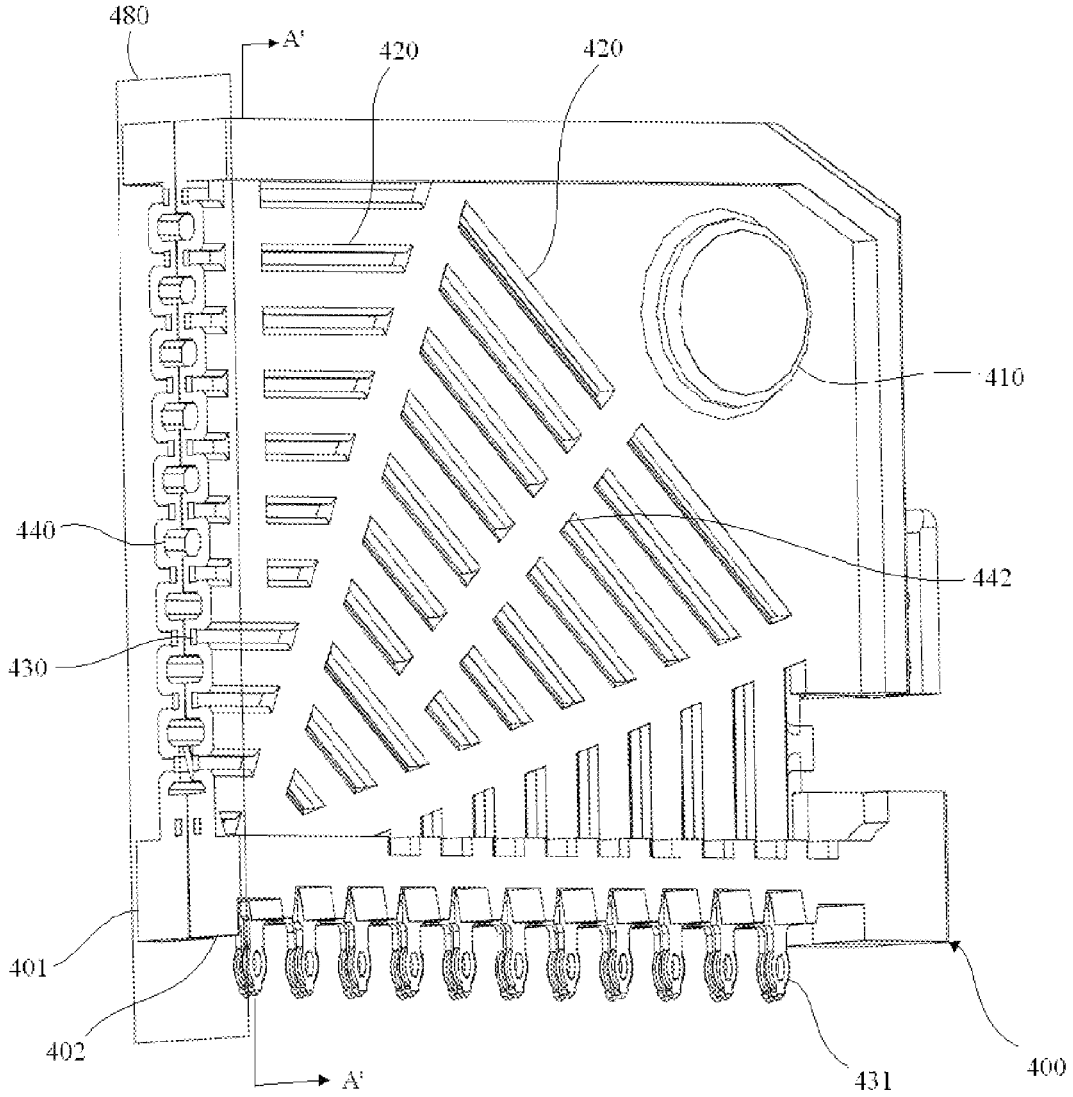
FIG. 22 illustrates a partial perspective view an embodiment of an alternate wafer construction.

By utilizing an intervening material, and by choosing the material for its dielectric properties, the impedance of the system may be changed from a 100 ohm differential signal impedance to a 50 ohm single-ended impedance. The designation of the terminals is left up to the end user, who will route the circuits on the board in a manner to benefit either differential signaling or single-ended signaling. As shown in FIG. 20, the insert maybe a separate element that is formed apart from the wafer frames. The insert may also be formed as part of one wafer with dielectric material that fully extends over interior one side of the connector wafer, as shown in FIG. 21. Each connector element in this embodiment is comprised of two half portions 202*a*, 202*b* and the left half of the connector elements 202*a* have an excess portion of dielectric material added to them so that they in effect, encase the left columns of terminal 206*a*. This material terminates in a hard and preferably flat edge 277, against which the right columns of terminals 106*b* and connector element halves 202*b* bear, thereby providing an engineered dielectric filling between the columns of terminals. By choosing the dielectric constant of this material the broadside coupling of the two rows of terminals 206*a*, 206*b* may be regulated, thereby tuning the impedance of such a connector structure.

FIGS. 22-29 illustrate features of an alternative embodiment that may be used to tune the impedance of the connector structure. The depicted terminals 430 are in a configuration that comprises terminal pairs that are broadside coupled, as previously discussed above. As noted with respect to FIG. 19, when a plurality of wafers are placed into a single housing, a first terminal pair can have a second terminal pair located on its side (e.g., in the same wafer) and can also have a third terminal pair next to it (e.g., in an adjacent wafer). Thus, as depicted in FIG. 19, it is possible to provide a first air channel between the terminals that make up the broadside coupled pair and a second air channel between pairs of broadside coupled terminals in adjacent wafers.

It has been determined that ensuring the first air channel (or air gap) between two terminals that form a broadside coupled pair is consistent can be difficult to do in a mass production environment because of the various tolerances involved. In addition, the first air channel between broadside coupled terminals implies a lack of material between terminals; this lack of material makes it more difficult to provide a distributed force on the two halves of the wafer so as to ensure the distance between the broadside coupled pair is maintained.

Figure 23A:
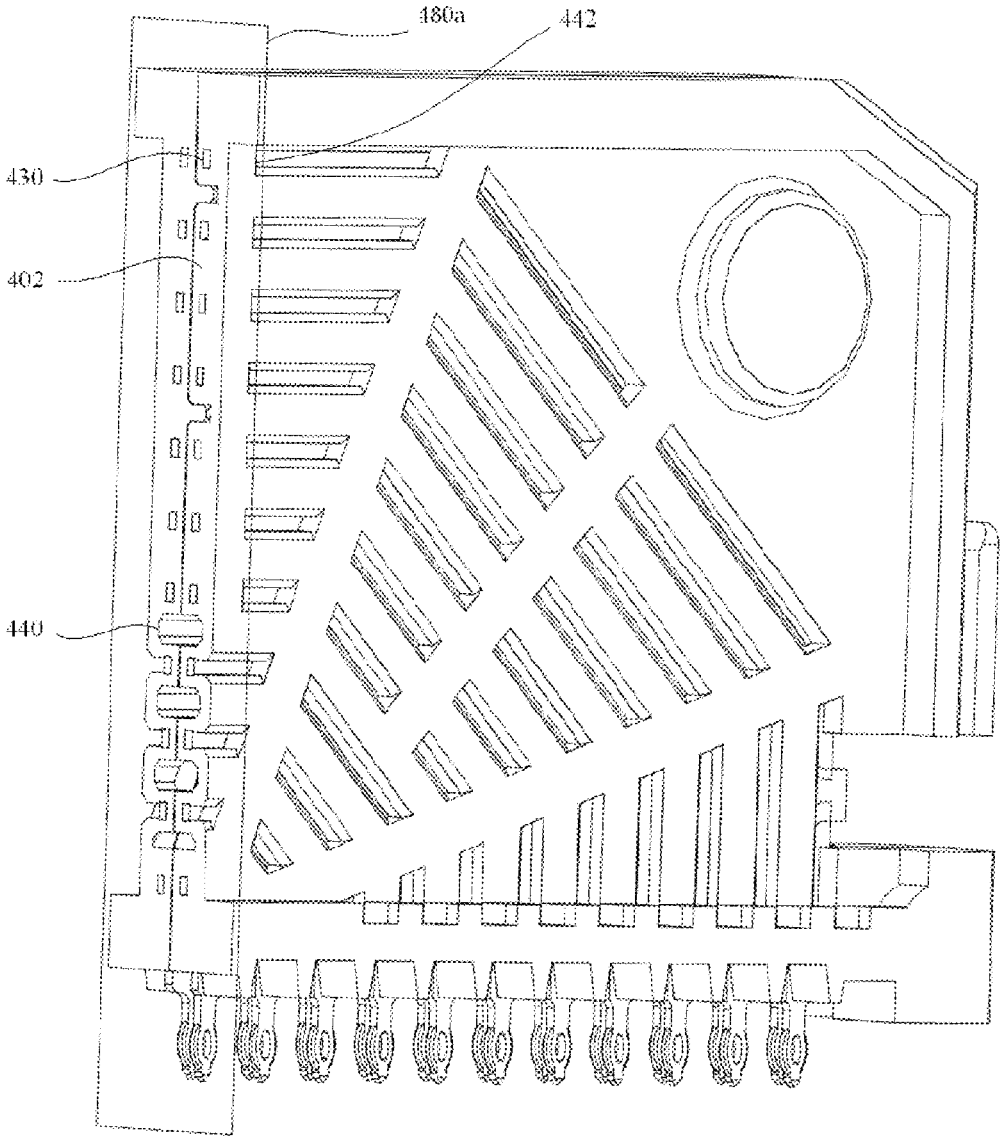
FIG. 23*a* illustrates a perspective view of the wafer depicted in FIG. 22 with a section made along line A'-A'.
Figure 23B:
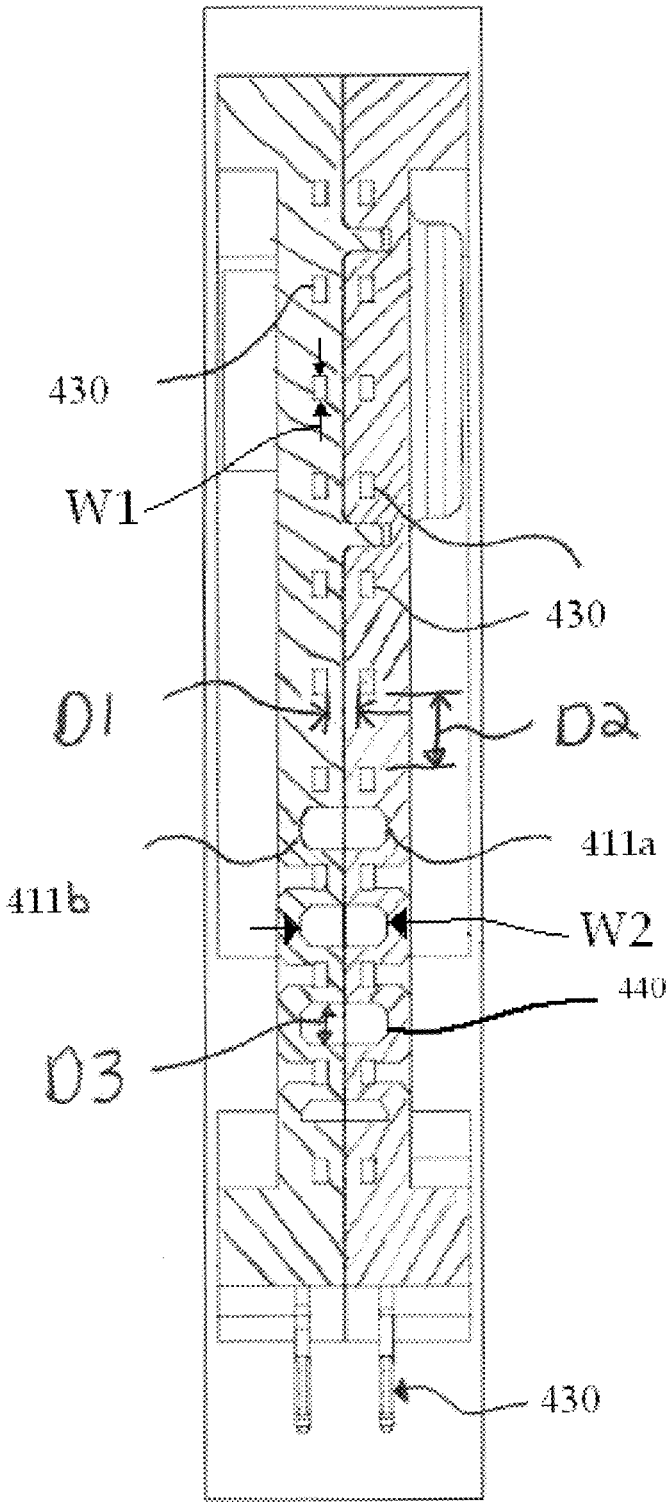
FIG. 23*b* illustrates an elevated side view of the wafer depicted in FIG. 23.
Figure 24:
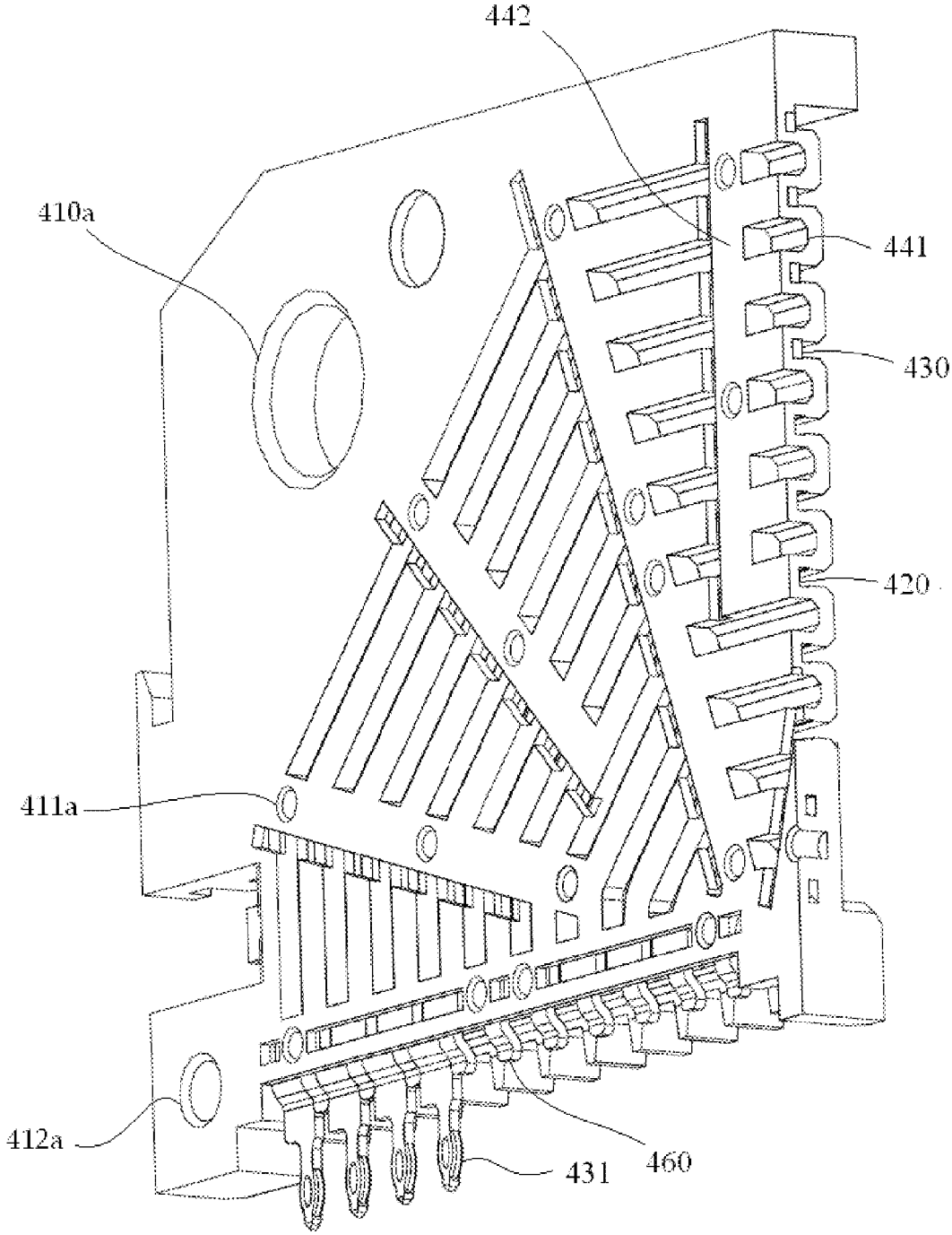
FIG. 24 illustrates a partial perspective view of the wafer depicted in FIG. 22.
Figure 25:
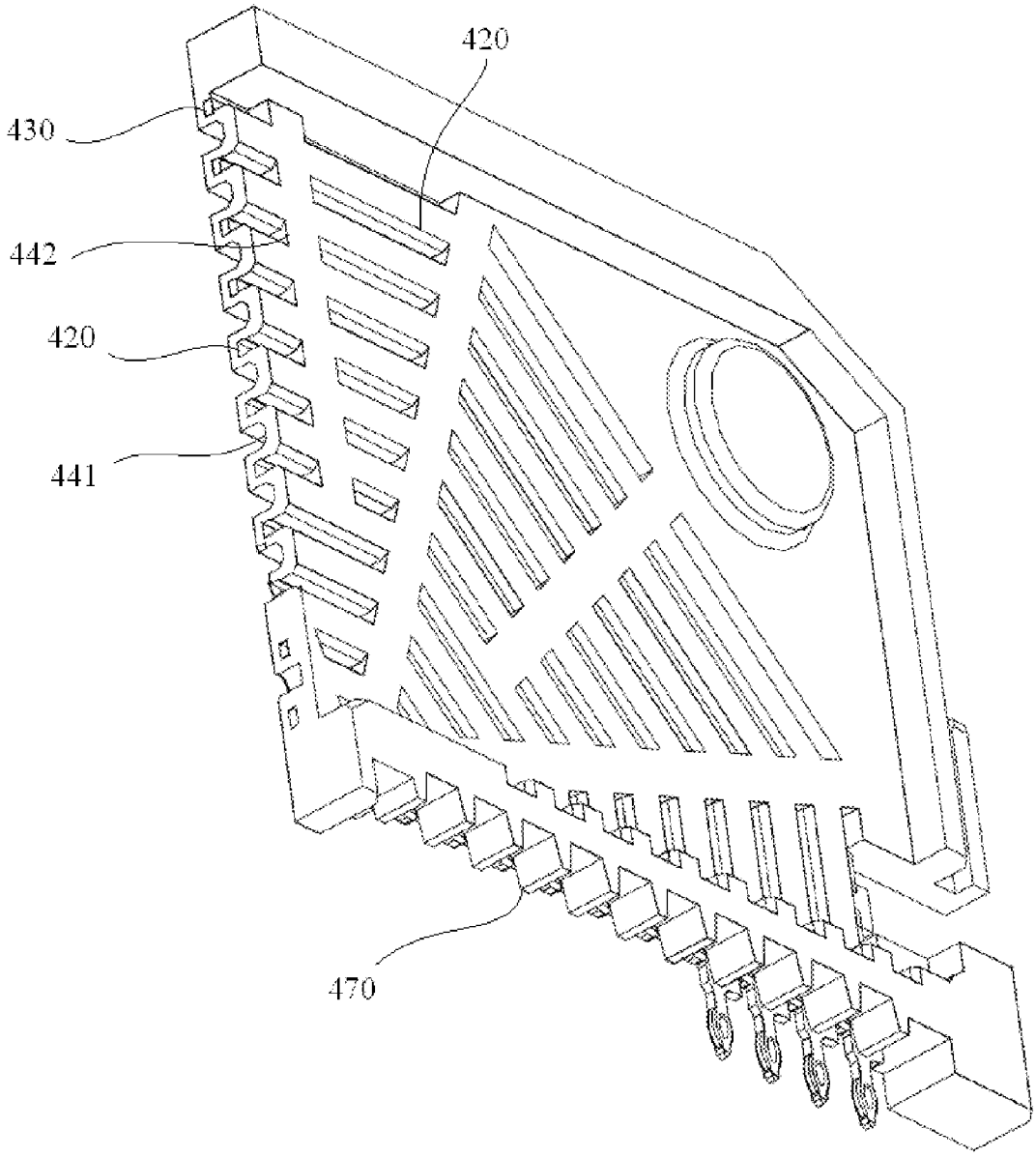
FIG. 25 illustrates another perspective view of the wafer depicted in FIG. 24.
Figure 26:
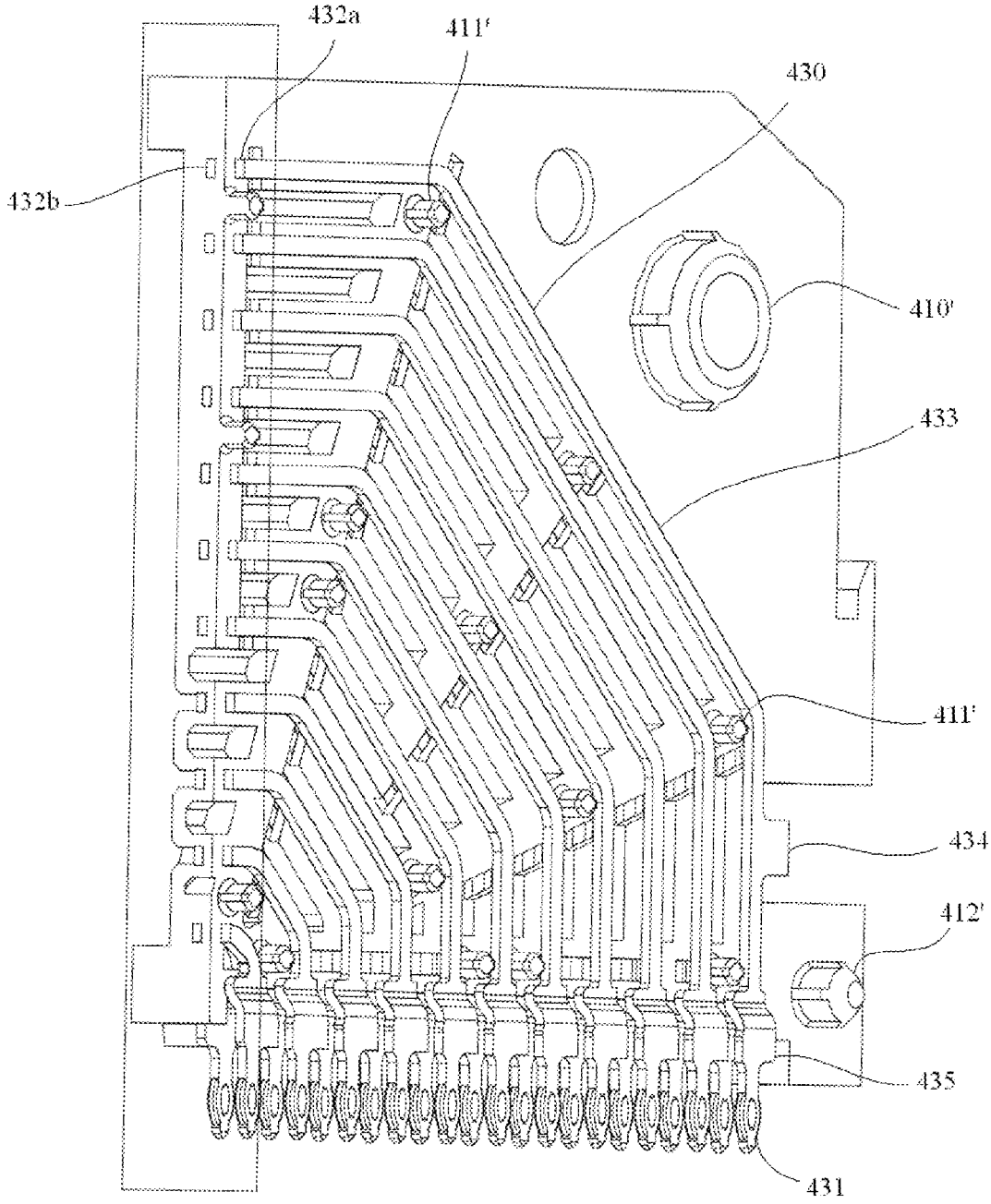
FIG. 26 illustrates a perspective view of the wafer depicted in FIG. 23*a* with one half of the wafer omitted for purposes of clarity.
Figure 27:
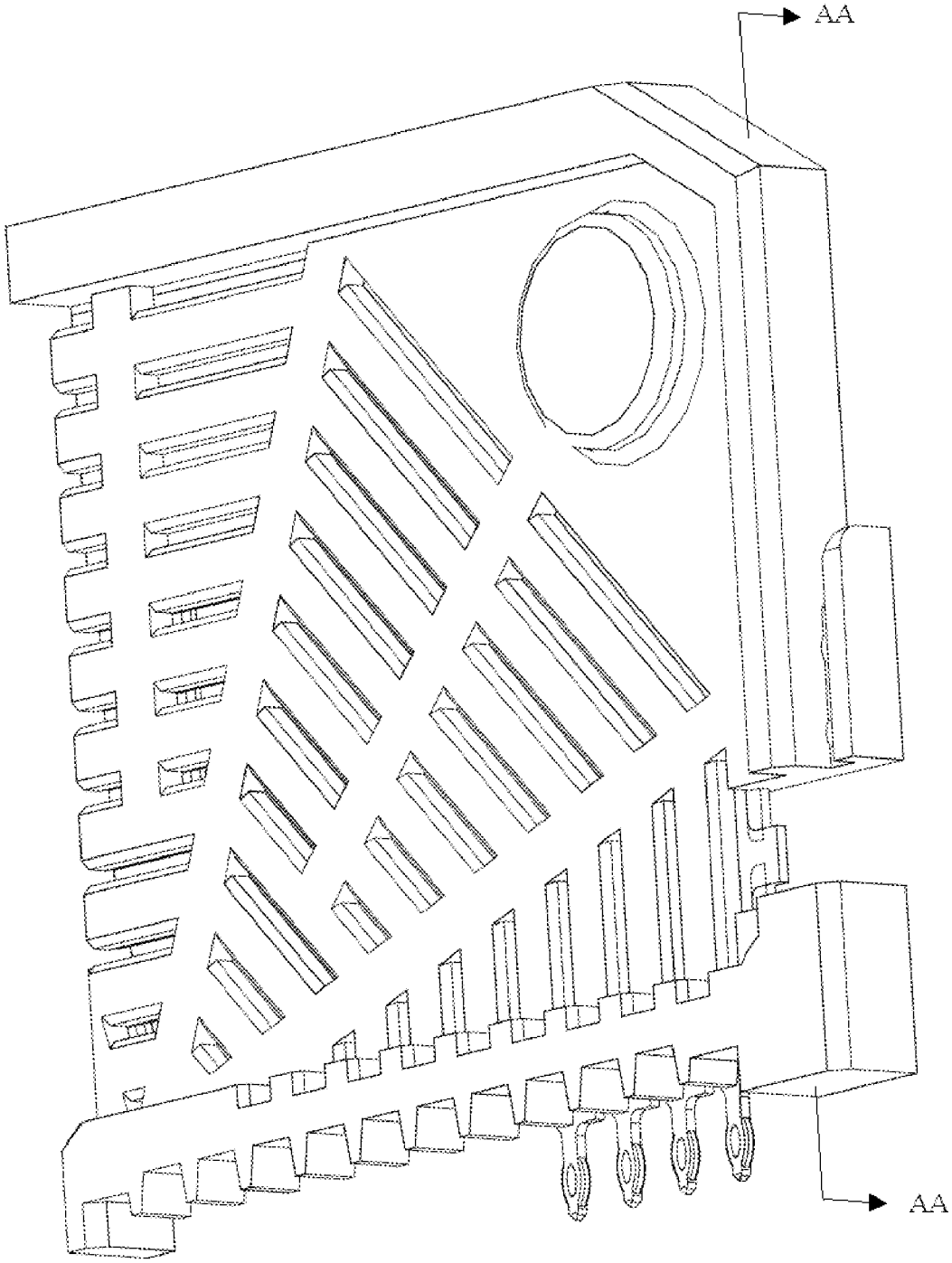
FIG. 27 illustrates another perspective view a the wafer depicted in FIG. 24.
Figure 28:
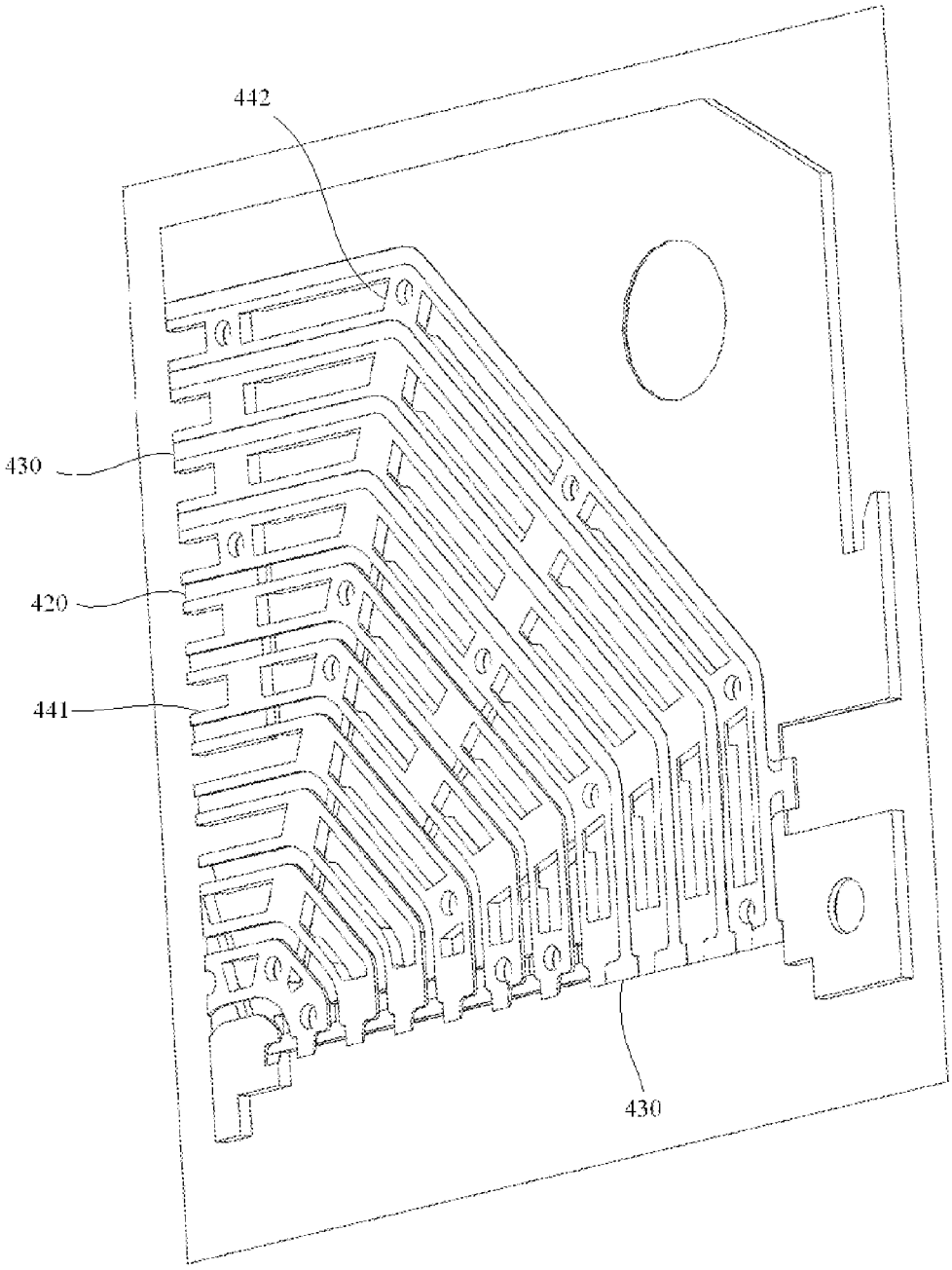
FIG. 28 illustrates a perspective cross-section of the wafer of FIG. 27 taken along line AA-AA.
Figure 29:
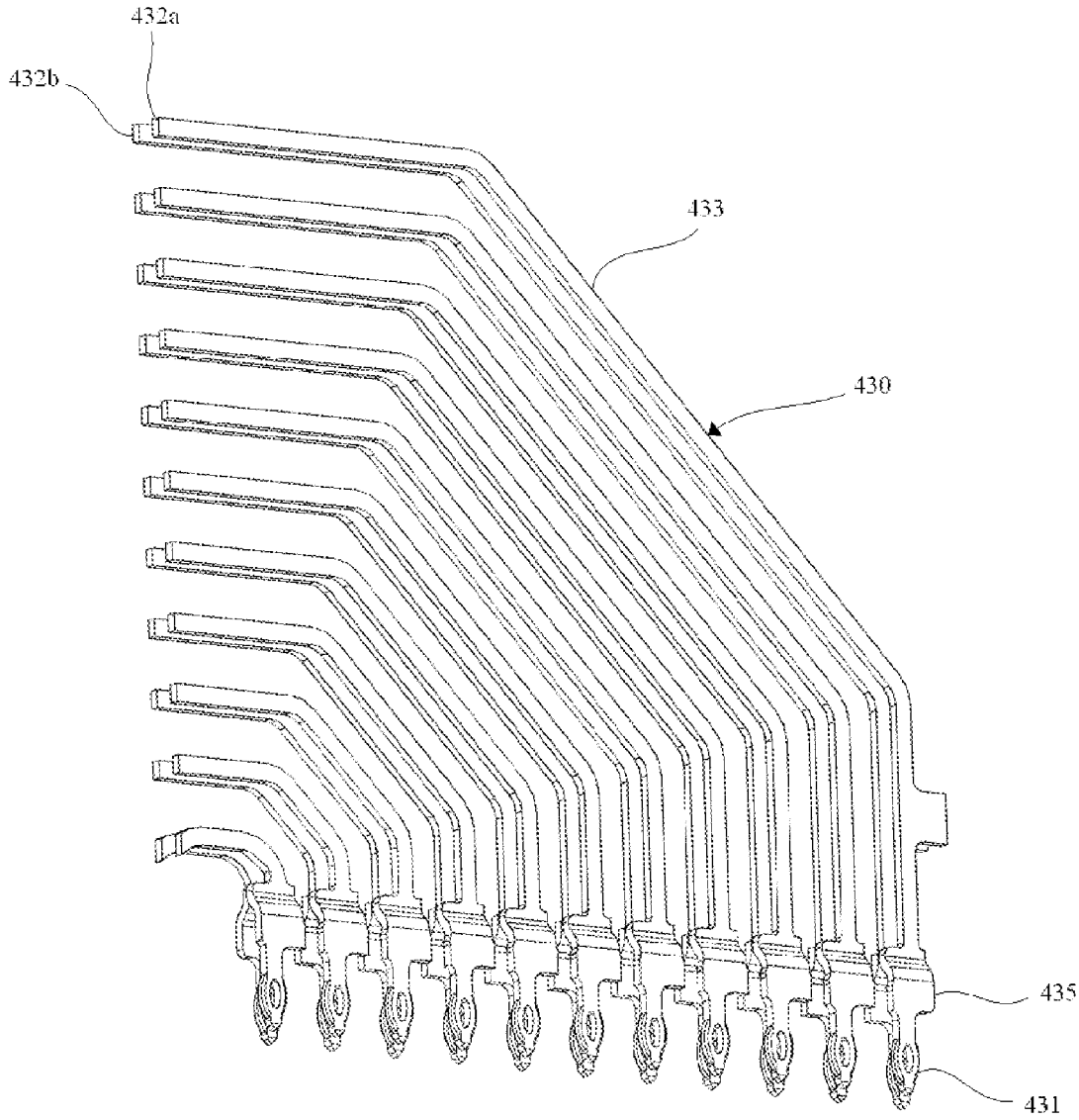
FIG. 29 illustrates a perspective simplified view of the wafer of FIG. 22 with the wafer dielectric removed.

To address the manufacturing issues associated with providing a consistently performing component in a mass-production environment, an embodiment as depicted in FIGS. 22-29 may be used. As illustrated in the cross section view made along plane 480 (which removes the contact portions of the terminals for the sake of clarity), the wafer 400 includes a first half 401 and a second half 402 that are configured to be mated together. In an embodiment, matching recessions 410*a*-412*a* and projections 410-412 and/or 410'-412' may be used to couple the first and second half together. As can be appreciated, coupling elements (such as the recessions and projections) may be situated throughout the wafer (e.g., not just on the edges but also in the interior of the wafer) so as to ensure the first and second half 401, 402 are consistently coupled together. For example, as depicted in FIGS. 24 and 26, recesses and projections are provided in ribs 442 that extend in a spoke-like manner.

Terminals 430, which include a board mating end 431 (which may be a desirable compliant pin configuration), a connector mating end 432 and a body 433 between the two ends, are situated in terminal channels 420 in the first and second half and the terminal channels 420 are U-shaped and aligned so that terminal channels 420 open away from each other when the first and second half 401,402 are assembled. To secure the terminals 430 in the terminal channels 420, the ribs 442 are provided over the terminal channels 420 and the terminals 430 so as to secure the terminals 430 into position. Once the terminals 430 are secured into position, the distance between two broadside coupled terminal pairs can be more carefully controlled and maintained in a mass production environment. This allows for a product that provides a level of consistent electrical performance.

Similar to the embodiment with a more continuous air channel as depicted in FIG. 19, an air channel 440 is provided between adjacent broadside coupled pairs so as to provide suitable electrical isolation. The air channel 440 is formed by joining to opposing slots 441 (slot 441 is also U-shaped) when the first and second half are coupled together. One difference compared to the embodiment depicted in FIG. 19, however, is that a more consistent distance between broadside coupled terminal pairs can be maintained under mass-production processes because the terminals are separated by a solid dielectric material that can be pressed together so as to ensure good dimensional stability. As can be appreciated, this allows the impedance of a terminal pair to be more consistently controlled. However, because of the dielectric material placed between two broadside coupled terminals, the width of the terminals will be reduced compared to a version where an air channel extends between two broadside coupled terminals in order to provide an impedance level that is substantially the same. Thus, for example, a 0.7 mm width dimension of a terminal could be reduced to terminal with a width of about 0.35 mm to compensate for the use of the dielectric material between the two terminals that form the terminal pair.

It should be noted that the slot 441 (and thus the air channel 440), while it extends along a path between adjacent broadside coupled pairs of terminals, does not extend the full length of the broadside coupled pair but instead is broken up by one or more ribs 442, which as noted above, helps secure the terminal 430 in position in the channel 420. In an embodiment, some of the terminals may be supported by twice the number of ribs as other terminals. It has been determined that such a configuration is sufficient to hold the terminals in position while also providing the benefit of limiting the use of material to where it is needed most. To further secure the terminal 430, a finger 460 (FIG. 24) extends so as to engage a shoulder 435 of terminal 430. This finger 460, in conjunction with tooth 470, helps ensure that the board mating portion 431 is securely held in position. In an embodiment, shoulder 535 is secured on a first side by a first finger, on a second side by a second finger and on a third side by a tooth positioned between the first and second finger.

As can be appreciated from FIG. 23*b*, along a cross section of terminals that are extending in a parallel direction, certain relationships may exist to provide a suitable configuration. For example, the distance D1 can be modified depending on the dielectric properties of the dielectric material provided (so as to obtain a desired impedance). In an embodiment, a broadside width W1 of the terminal 430 divided by D1 will result in a ratio (R1) with a value of less than 1.0 so as to allow for a suitably dense connector. In an embodiment, the ratio (R2) of the distance between two adjacent broadside coupled terminal pairs (D2) divided by the width of the broadside coupled terminal W1 can be in a range of about 2.5 to about 3.5, for example about 3. In other words, D1 divided by D2 can be less than about 3.5. D3 represents a height of the air channel 440. In an embodiment, a ratio (R3) of a width W2 of air channel 440 over D3 will range between 1.6 and 2.5 and in an embodiment will be about 2. In addition, in an embodiment a ratio (R4) of D2/D3 will be in a range of 1.5 to 2 and may be about 1.75. As can be appreciated, increasing the ratio R4 will increase the effectiveness of the air channel but will tend to weaken the wafer, thus care is required if the ration R4 is decreased below 1.5.

While exemplary embodiments of the invention have been shown and described, it will be apparent to those skilled in the art that changes and modifications may be made therein without departing from the spirit of the invention.

The invention claimed is:

1. A high speed connector, comprising:

a wafer of connector elements, the wafer supporting first and second columns of conductive terminals, each of the terminals including a contact portion, a tail portion and a body portion interconnecting the contact and tail portions together, the terminals in each column supported by a plurality of ribs, the first and second columns of terminals being configured so that a terminal from the first column and the second column form a row, wherein a first row of terminals are broadside coupled to form a first terminal pair that is separated by a space and a second row of terminals are broadside coupled to form a second terminal pair separated by the space, wherein the space between the terminals that form terminal pairs is filled with a dielectric, and wherein an air channel is provided between the first and second terminal pair such that the first and second terminal pair are separated by an air channel that extends substantially along a path between the first and second terminal pairs, the air channel providing increased electrical separation between the first and second terminal pairs, the air channel being traversed by at least one of the plurality of ribs, wherein the wafer is formed from a first half and a second half and the air channel is formed from a slot in the first half and a slot in the second half.

2. The connector of claim 1, wherein the high speed connector includes at least two wafer.

3. The connector of claim 1, wherein the air channel has a width W2 and a height D3, wherein a ratio of the width over the height is between about 1.6 and about 2.5.

4. The connector of claim 3, wherein the ratio is about 2.

5. The connector of claim 1, wherein the terminals have a width W1 and there is a distance D2 between the first and second terminal pair and the ratio of W1 over D2 is between 2.5 and 3.5.

6. The connector of claim 1, wherein there is a distance D2 between the first and second terminal pair and the air channel has a height D3 and a ratio of D2 over D3 is less than 2.0.

7. The connector of claim 1, wherein there are at least four rows of broadside coupled terminal pairs and one of the at least four terminals pairs is supported by twice as many ribs as another of the at least four terminal pairs.

* * * * *